US011891995B2

(12) United States Patent
Seol et al.

(10) Patent No.: US 11,891,995 B2
(45) Date of Patent: Feb. 6, 2024

(54) ROTARY COMPRESSOR HAVING IMPROVED VANE CHATTERING PERFORMANCE

(71) Applicant: LG ELECTRONICS INC., Seoul (KR)

(72) Inventors: Seseok Seol, Seoul (KR); Seoungmin Kang, Seoul (KR); Joonhong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/869,037

(22) Filed: Jul. 20, 2022

(65) Prior Publication Data

US 2023/0088672 A1 Mar. 23, 2023

(30) Foreign Application Priority Data

Sep. 17, 2021 (KR) ..... 10-2021-0125271

(51) Int. Cl.
*F04C 18/344* (2006.01)
*F04C 29/12* (2006.01)
(Continued)

(52) U.S. Cl.
CPC ..... *F04C 18/3445* (2013.01); *F04C 18/3442* (2013.01); *F04C 29/124* (2013.01);
(Continued)

(58) Field of Classification Search
CPC F04C 18/3445; F04C 18/3442; F04C 29/124; F04C 18/3441; F04C 23/008; F04C 2240/40; F04C 2240/50; F01C 21/0809
See application file for complete search history.

(56) References Cited

U.S. PATENT DOCUMENTS

2020/0149531 A1 5/2020 Park et al.
2020/0224656 A1* 7/2020 Moon ..... F01C 21/0809

FOREIGN PATENT DOCUMENTS

JP 59-103984 6/1984
JP 60-32989 2/1985
(Continued)

OTHER PUBLICATIONS

English Machine Translation of JP2014-125962A (Year: 2014).*
(Continued)

*Primary Examiner* — Dominick L Plakkoottam
*Assistant Examiner* — Paul W Thiede
(74) *Attorney, Agent, or Firm* — KED & ASSOCIATES

(57) ABSTRACT

A rotary compressor may include a cylinder having an inner peripheral surface that defines a compression space, and provided with a suction port configured to communicate with the compression space and through which refrigerant is suctioned into the compression space; a roller rotatably provided in the compression space of the cylinder, and having a plurality of vane slots that provides a back pressure at one side thereinside and provided at a predetermined interval along an outer peripheral surface of the roller; and a plurality of vanes slidably inserted into the vane slots, respectively, and configured to rotate together with the roller, front end surfaces of which come into contact with the cylinder due to the back pressure to partition the compression space into a plurality of compression chambers. High-pressure refrigerant may be accommodated between one of the vanes and the cylinder.

20 Claims, 12 Drawing Sheets

(51) Int. Cl.
*F04C 23/00* (2006.01)
*F01C 21/08* (2006.01)

(52) U.S. Cl.
CPC ..... *F01C 21/0809* (2013.01); *F04C 18/3441* (2013.01); *F04C 23/008* (2013.01); *F04C 2240/40* (2013.01); *F04C 2240/50* (2013.01); *F04C 2240/603* (2013.01)

(56) References Cited

FOREIGN PATENT DOCUMENTS

| | | |
|---|---|---|
| JP | 2014-125962 | 7/2014 |
| JP | 2014-218985 | 11/2014 |
| KR | 10-2020-0107204 | 9/2020 |

OTHER PUBLICATIONS

Korean Office Action dated Sep. 13, 2022 issued in Application No. 10-2021-0125271.
European Search Report issued in Application No. 22187359.9 dated Jan. 18, 2023.

* cited by examiner

MEASUREMENT RESULT (ACCELERATION, %)

| | BEFORE LIQUID INFLOW (STABILIZATION STATE) | | LIQUID INFLOW (INTERMITTENT) | |
|---|---|---|---|---|
| | DISCHARGE SIDE | SUCTION SIDE | DISCHARGE SIDE | SUCTION SIDE |
| EXISTING STRUCTURE | 100% | 100% | 286% | 343% |
| PATENT STRUCTURE | 55% | 129% | 75% | 110% |

ROTARY COMPRESSOR HAVING IMPROVED VANE CHATTERING PERFORMANCE

CROSS-REFERENCE TO RELATED APPLICATION(S)

Pursuant to 35 U.S.C. § 119(a), this application claims the benefit of an earlier filing date of and the right of priority to Korean Patent Application No. 10-2021-0125271, filed in Korea Sep. 17, 2021, the contents of which are incorporated by reference herein in its entirety.

BACKGROUND

1. Field

A rotary compressor is disclosed herein.

2. Background

A compressor may be divided into a reciprocating compressor, a rotary compressor, and a scroll compressor according to a method of compressing a fluid, such as refrigerant. The reciprocating compressor uses a method in which a compression space is disposed between a piston and a cylinder, and the piston linearly reciprocates to compress a fluid, the rotary compressor uses a method of compressing a fluid by a roller that eccentrically rotates inside of a cylinder, and the scroll compressor uses a method in which a pair of spiral scrolls engage and rotate to compress a fluid.

Among them, the rotary compressor may be divided according to a method in which the roller rotates with respect to the cylinder. For example, the rotary compressor may be divided into an eccentric rotary compressor in which a roller rotates eccentrically with respect to a cylinder, and a concentric rotary compressor in which a roller rotates concentrically with respect to a cylinder.

In addition, the rotary compressor may be divided according to a method of dividing a compression chamber. For example, it may be divided into a vane rotary compressor in which vanes come into contact with a roller or a cylinder to partition a compression space, and an elliptical rotary compressor in which a portion of an elliptical roller comes into contact with a cylinder to partition a compression space. The rotary compressor as described above is provided with a drive motor, a rotational shaft is coupled to a rotor of the drive motor, and a rotational force of the drive motor is transmitted to a roller through the rotational shaft to compress refrigerant.

Japanese Patent Application Laid-Open No. 2014-125962 (hereinafter "Patent Document 1"), which is hereby incorporated by reference, discloses a gas compressor including a rotor, a cylinder having an inner peripheral surface surrounding an outer peripheral surface of the rotor, a plurality of plate-shaped vanes slidably inserted into a vane groove disposed in the rotor, and two side blocks respectively blocking both ends of the rotor and the cylinder. The vanes come into contact with the inner peripheral surface of the cylinder to define a plurality of compression chambers with front ends of the vanes, and a contour shape of the inner peripheral surface of the cylinder is set such that each of those defined compression chambers performs only one cycle of suction, compression, and discharge of gas during one rotation of the rotor.

As in Patent Document 1, a vane-type compressor has a multi-back pressure structure to ensure performance and reliability by a contact force between a vane and a cylinder. Further, an intermediate pressure is formed at a rear end of the vane to reduce friction loss between the cylinder and the vane in a suction section, and a discharge back pressure is formed to prevent the vane from being pushed back in a discharge section.

The discharge back pressure in the discharge section is connected to a contact point with a smallest gap between the cylinder and the rotor. The contact point is a boundary dividing the discharge section and the suction section, and in order to minimize friction loss at the suction side, most current vane type compressors have structures of maintaining the discharge back pressure up to the contact point. However, there is a problem in that when the vane passes the contact point, a high-pressure or extreme-pressure source stagnated between a rotor vane groove width and a vane nose momentarily pushes the vane back at the end of the discharge back pressure and then a chattering phenomenon that strikes near the suction port may occur.

In addition, in an existing vane type multi-back pressure structure, there is also a problem in that when liquid flows in, high-pressure liquid remains in a dead volume between the rotor and the vane nose portion, and a chattering phenomenon may occur by pushing the vane in a section where the back pressure drops. Due to this chattering phenomenon, an efficiency of the compressor is lowered, and there is a problem in reliability of the compressor, and thus, improvement is required.

In particular, a discharge back pressure may be maintained so as not to push the vane back until accumulated high-pressure refrigerant is bypassed to the suction port at a side surface of the cylinder. Thus, development of a rotary compressor is required to prevent a chattering phenomenon and improve efficiency and reliability of the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
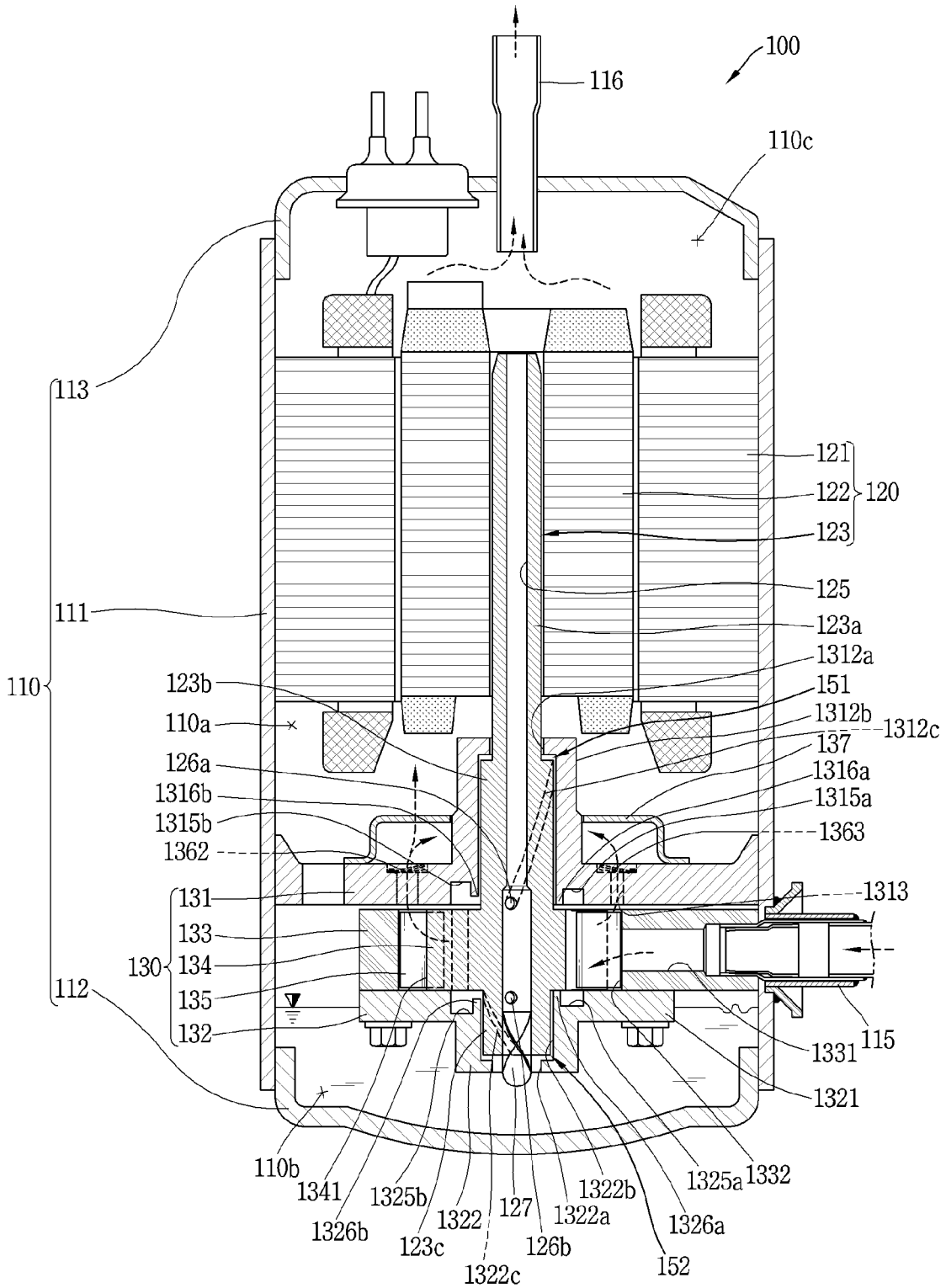
FIG. 1 is a longitudinal cross-sectional view of a rotary compressor according to an embodiment.

In the present specification, the same or similar reference numerals are assigned to the same or similar components in different embodiments, and redundant description thereof has been omitted. Further, structure applied to any one embodiment may be also applied in the same manner to another embodiment as long as they do not structurally or functionally contradict each other even in different embodiments.

A singular representation may include a plural representation unless it represents a definitely different meaning from the context.

In describing an embodiment disclosed herein, moreover, description has been omitted when specific description for publicly known technologies to which the invention pertains is judged to obscure the gist.

The accompanying drawings are provided only for a better understanding of the embodiments disclosed herein and are not intended to limit technical concepts disclosed herein, and therefore, it should be understood that the accompanying drawings include all modifications, equivalents and substitutes within the concept and technical scope.

Figure 2:
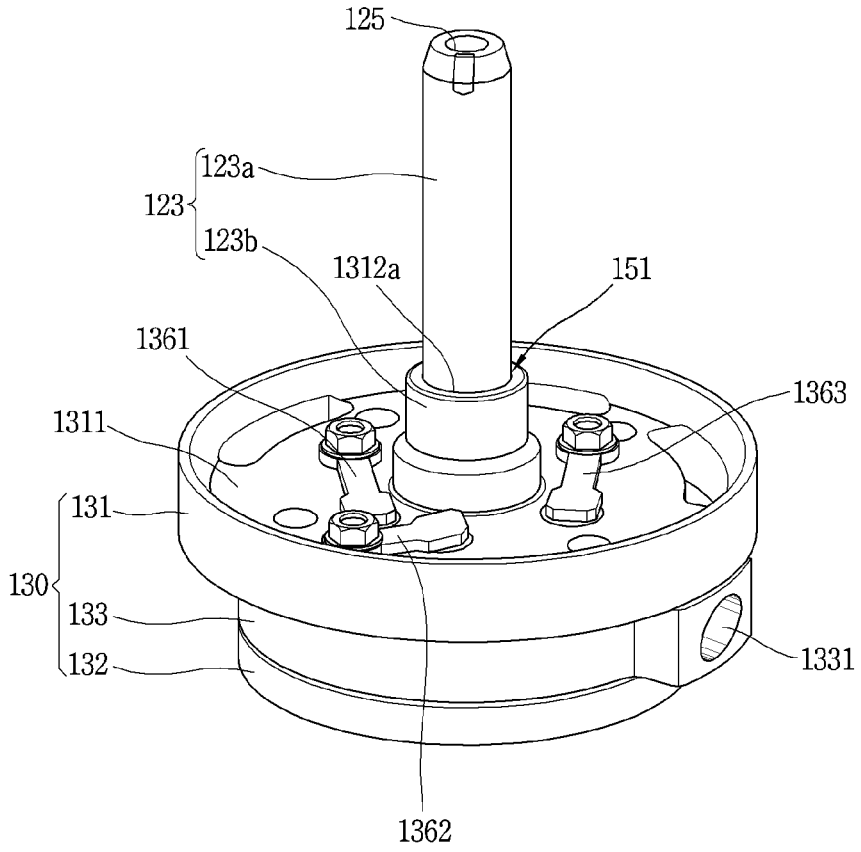
FIG. 2 is a perspective view of a compression unit of the rotary compressor of FIG. 1.
Figure 3:
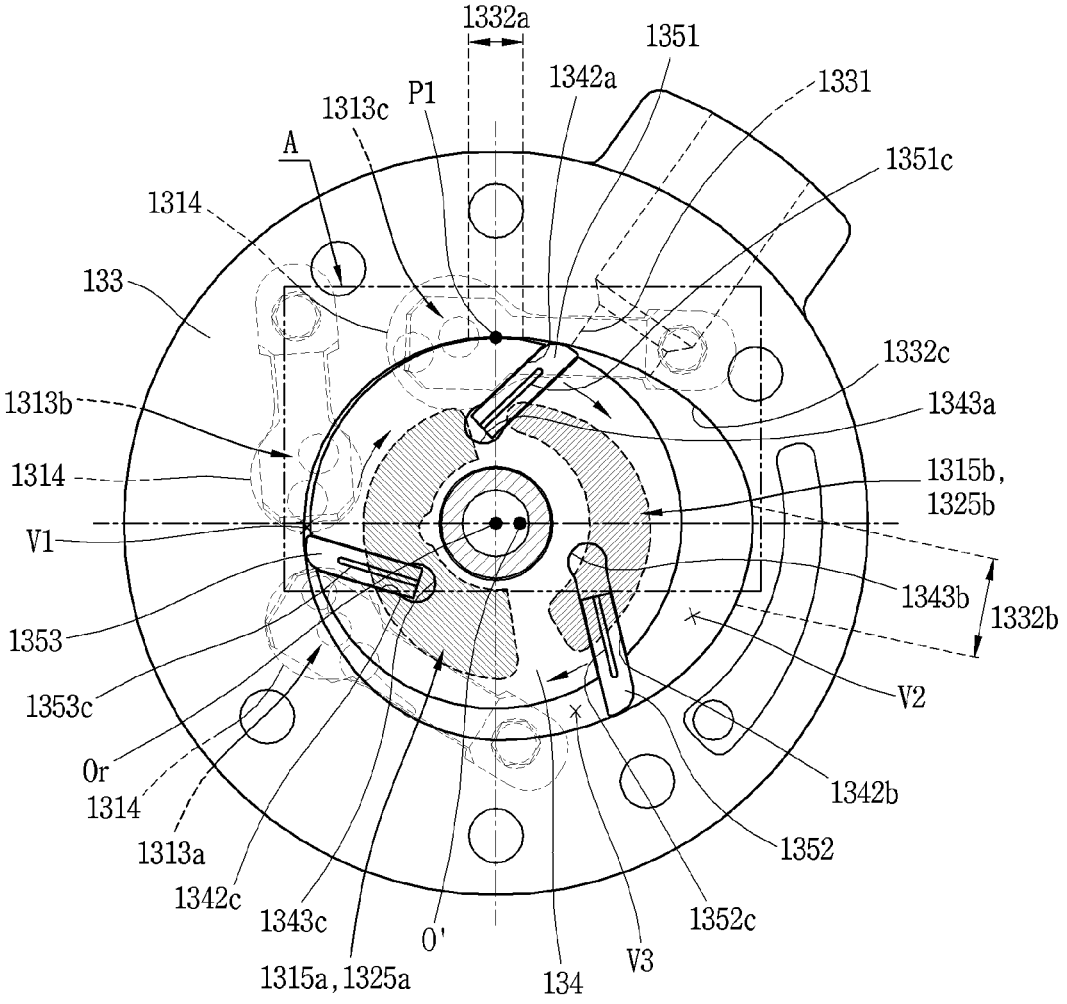
FIG. 3 is a transverse cross-sectional view of the compression unit of the rotary compressor of FIG. 1.
Figure 4:
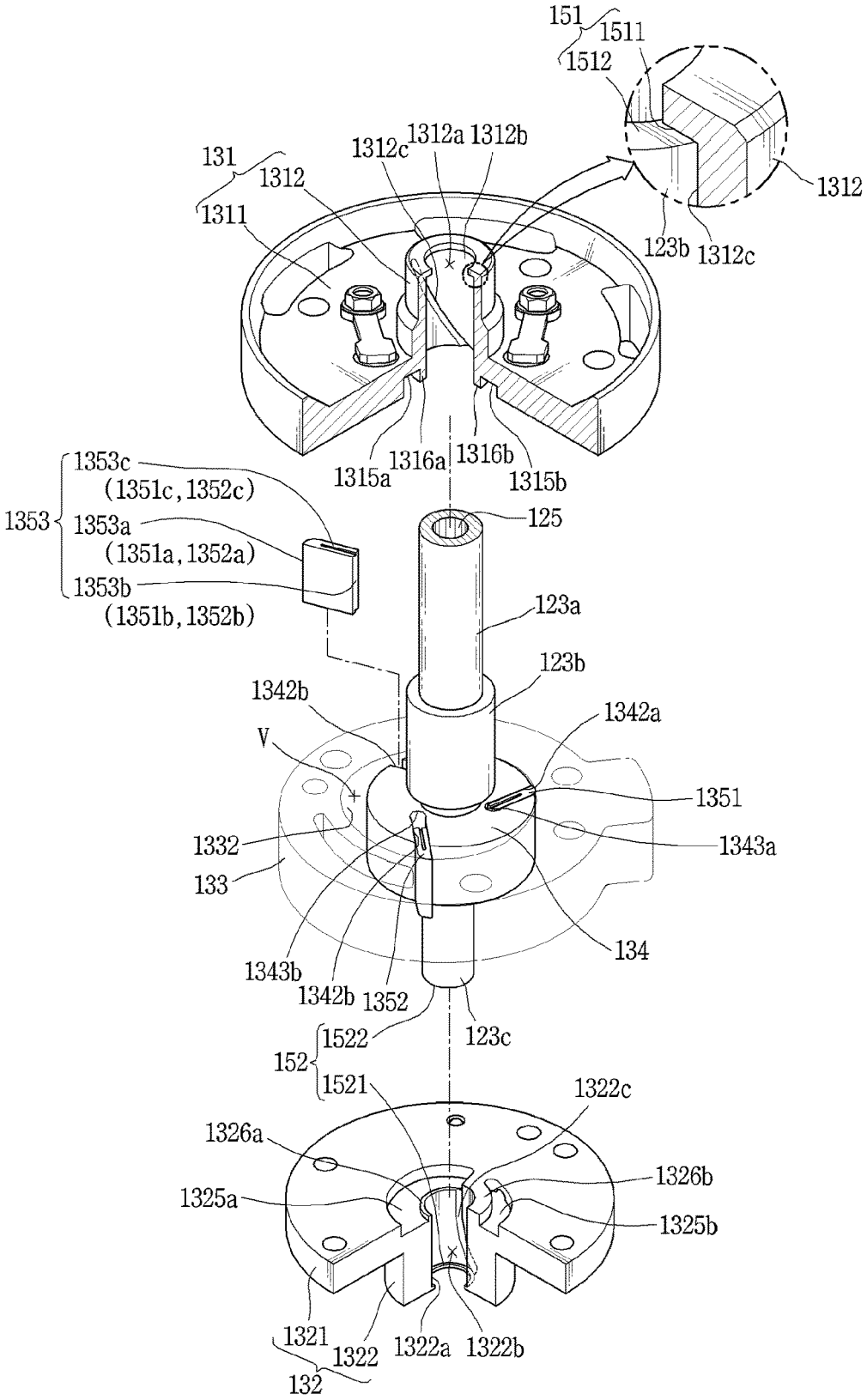
FIG. 4 is an exploded perspective view of the compression unit of the rotary compressor of FIG. 1.

FIG. 1 is a longitudinal cross-sectional view of a rotary compressor according to an embodiment. FIG. 2 is a perspective view of a compression unit of the rotary compressor of FIG. 1. FIG. 3 is a transverse cross-sectional view of the compression unit of the rotary compressor of FIG. 1. FIG. 4 is an exploded perspective view of the compression unit of the rotary compressor of FIG. 1.

Hereinafter, rotary compressor 100 according to an embodiment will be described with reference to FIGS. 1 to 4. The rotary compressor 100 according to an embodiment may be a vane rotary compressor 100.

Referring to FIGS. 3 and 4, the rotary compressor 100 may include a cylinder 133, a roller 134, and a plurality of vanes 1351, 1352, 1353 (135). The cylinder 133 may be configured with an annular inner peripheral surface to define a compression space V. Further, the cylinder 133 may include a suction port 1331, and the suction port 1331 may be disposed to communicate with the compression space V to suction refrigerant and provide it to the compression space V. Reference numeral 116 is a discharge pipe.

An inner peripheral surface 1332 of the cylinder 133 may be defined in an elliptical shape, and the inner peripheral surface 1332 of the cylinder 133 may be combined such that a plurality of ellipses, for example, four ellipses having different major and minor ratios have two origins to define an asymmetric elliptical shape, and description of the shape of the inner peripheral surface of the cylinder 133 will be described hereinafter.

The roller 134 may be rotatably provided in the compression space V of the cylinder 133. In addition, the roller 134 may be configured with a plurality of vane slots 1342*a*, 1342*b*, 1342*c* at a predetermined interval along an outer peripheral surface. Further, the compression space V may be defined between an inner periphery of the cylinder 133 and an outer periphery of the roller 134.

That is, the compression space V may be a space defined between the inner peripheral surface of the cylinder 133 and the outer peripheral surface of the roller 134. In addition, the compression space V may be divided into spaces as many as the number of vanes 1351, 1352, 1353 by the plurality of vanes 1351, 1352, 1353.

For example, referring to FIG. 3, an example is illustrated in which the compression space V is partitioned into a first compression space V1 provided at a side of discharge ports 1313*a*, 1313*b*, 1313*c*, a second compression space V2 provided at a side of the suction port 1331, and a third compression space V3 provided between the side of the suction port 1331 and the side of the discharge ports 1313*a*, 1313*b*, 1313*c* by the three vanes 1351, 1352, 1353.

The vanes 1351, 1352, 1353 may be slidably inserted into the vane slots 1342*a*, 1342*b*, 1342*c*, and configured to rotate together with the roller 134. In addition, a back pressure may be provided at a rear end of the vane 1351, 1352, 1353 to allow a front end surface 1351*a*, 1352*a*, 1353*a* of the vane 1351, 1352, 1353 to come into contact with the inner periphery of the cylinder 133.

In embodiments disclosed herein, a plurality of vanes 1351, 1352, 1353 are provided in plurality to define a multi-back pressure structure, and the front end surfaces 1351*a*, 1352*a*, 1353*a* of the plurality of vanes 1351, 1352, 1353 come into contact with the inner periphery of the cylinder 133, thereby allowing the compression space V to be partitioned into the plurality of compressed spaces V1, V2, V3. An example in which three vanes 1351, 1352, 1353 are provided is illustrated in FIG. 3, for example, thereby allowing the compression space V to be partitioned into the three compression spaces V1, V2, V3.

In the rotary compressor 100, high-pressure refrigerant is accommodated between one of the plurality of vanes 1351, 1352, 1353 and the inner periphery of the cylinder 133, and a predetermined back pressure is maintained to allow the front end surfaces 1351*a*, 1352*a*, 1353*a* of the vanes 1351, 1352,1353 to come into contact with the inner periphery of the cylinder 133 until the high-pressure refrigerant is bypassed to the suction port 1331.

The predetermined back pressure may be understood as a discharge back pressure that enables the high-pressure refrigerant to be discharged into an inner space of a casing 110 through the discharge ports 1313*a*, 1313*b*, 1313*c* of the compression space V. In addition, a time point at which the high-pressure refrigerant is bypassed to the suction port 1331 may be understood as a "suction start time point", which is a time point at which suction starts.

Hereinafter, the rotary compressor 100 will be described. Referring to FIG. 1, the rotary compressor 100 according to an embodiment may further include the casing 110 and a drive motor 120 provided inside of the casing 110 to generate rotational power. The drive motor 120 may be provided in an upper inner space 110*a* of the casing 110, and the compression unit 130 in a lower inner space 110*b* of the casing 110, respectively, and the drive motor 120 and the compression unit 130 may be connected by a rotational shaft 123.

The casing 110, which is a portion constituting an exterior of the compressor, may be divided into a vertical or horizontal type depending on an aspect of installing the compressor. The vertical type has a structure in which the drive motor 120 and the compression unit 130 are disposed at upper and lower sides along an axial direction, and the horizontal type has a structure in which the drive motor 120 and the compression unit 130 are disposed at left and right or lateral sides. The casing 110 according to embodiments will mainly be described with respect to the vertical type, but the casing 110 may also be applied to the horizontal type.

The casing 110 may include an intermediate shell 111 defined in a cylindrical shape, a lower shell 112 that covers a lower end of the intermediate shell 111, and an upper shell 113 that covers an upper end of the intermediate shell 111. The drive motor 120 and the compression unit 130 may be inserted into and fixedly coupled to the intermediate shell 111, and a suction pipe 115 may be passed therethrough to be directly connected to the compression unit 130. The lower shell 112 may be sealingly coupled to a lower end of the intermediate shell 111, and a storage oil space 110*b* in which oil to be supplied to the compression unit 130 is stored may be disposed below the compression unit 130. The upper shell 113 may be sealingly coupled to an upper end of the intermediate shell 111, and an oil separation space 110*c* may be disposed above the drive motor 120 to separate oil from refrigerant discharged from the compression unit 130.

The drive motor 120, which is a portion constituting the electric motor unit, provides power to drive the compression unit 130. The drive motor 120 may include a stator 121, a rotor 122, and the rotational shaft 123.

The stator 121 may be fixedly provided inside of the casing 110, and may be, for example, press-fitted and fixed to an inner peripheral surface of the casing 110 by a method, such as shrink fitting, for example. For example, the stator 121 may be, for example, press-fitted and fixed to an inner peripheral surface of the intermediate shell 111.

The rotor 122 may be rotatably inserted into the stator 121, and the rotational shaft 123 may be, for example, press-fitted and coupled to a center of the rotor 122. Accordingly, the rotational shaft 123 may rotate concentrically together with the rotor 122.

An oil flow path 125 is defined in a hollow hole shape at the center of the rotational shaft 123, and oil through holes 126*a*, 126*b* may be disposed to pass therethrough toward an outer peripheral surface of the rotational shaft 123 in a middle of the oil flow path 125. The oil through holes 126*a*, 126*b* may include first oil through hole 126*a* belonging to a range of a main bush portion 1312 and second oil through hole 126*b* belonging to a range of a second bearing portion 1322, which will be described hereinafter. Each of the first oil through hole 126*a* and the second oil through hole 126*b* may be configured as one or a plurality. This embodiment shows an example that is configured as a plurality of oil through holes.

An oil pickup 127 may be provided in the middle or at a lower end of the oil flow path 125. For example, the oil pickup 127 may include one of a gear pump, a viscous pump, or a centrifugal pump. This embodiment shows an example to which a centrifugal pump is applied. Accordingly, when the rotational shaft 123 rotates, oil filled in the oil storage space 110*b* of the casing 110 may be pumped by the oil pickup 127, and the oil may be suctioned up along the oil flow path 125 and then supplied to a sub bearing surface 1322*b* of the sub bush portion 1322 through the second oil through hole 126*b*, and to a main bearing surface 1312*b* of the main bush portion 1312 through the first oil through hole 126*a*.

Further, the rotational shaft 123 may be integrally formed with the roller 134 or the roller 134 may be press-fitted and post-assembled thereto, for example. In this embodiment, an example is described in which the roller 134 is integrally formed with the rotational shaft 123, but the roller 134 will be described hereinafter.

In the rotational shaft 123, a first bearing support surface 151 may be disposed at an upper half portion of the rotational shaft 123 with respect to the roller 134, that is, between a main shaft portion 123*a* press-fitted into the rotor 122 and a main bearing portion 123*b* (1312) extending toward the roller 134 from the main bearing portion 123*b* formed between the main bearing portion 123*b*, and a second bearing support surface 152 may be disposed at a lower half portion of the rotational shaft 123 with respect to the roller 134, that is, on the rotational shaft 123 at a lower end of the sub bearing 132. The first bearing support surface 151 constitutes a first axial support portion 1511 together with a first shaft support surface 1512, and the second bearing support surface 152 constitutes a second shaft support portion 1521 together with a second shaft support surface 1522.

The rotary compressor 100 may further include main bearing 131 and sub bearing 132. The main bearing 131 and the sub bearing 132 may be respectively provided at both ends of the cylinder 133. The main bearing 131 and the sub bearing 132 may be disposed to be spaced apart from each other to constitute both surfaces of the aforementioned compression space V, respectively.

For example, referring to FIGS. 1, 2 and 4, an example is shown in which the main bearing 131 is provided at an upper end of the cylinder 133 to define an upper surface of the compression space V, and the sub bearing 132 is provided at a lower end of the cylinder 133 to define a lower surface of the compression space V. At least one of the main bearing 131 or the sub bearing 132 may be provided with at least one of back pressure pockets 1315*a*, 1315*b*, 1325*a*, 1325*b* concavely disposed to communicate with the compression space V.

The back pressure chamber 1343*a*, 1343*b*, 1343*c* may be disposed at an inner end of the vane slot 1342*a*, 1342*b*, 1342*c*. The back pressure chamber 1343*a*, 1343*b*, 1343*c* receives a back pressure from the back pressure pocket 1315*a*, 1315*b*, 1325*a*, 1325*b* while communicating with the back pressure pocket 1315*a*, 1315*b*, 1325*a*, 1325*b* to pressurize the vane 1351, 1352, 1353 toward the inner periphery of the cylinder 133.

The back pressure chamber 1343*a*, 1343*b*, 1343*c* may be provided at the inner end of the vane slot 1342*a*, 1342*b*, 1342*c*, and may be understood as a space defined between the rear end of the vane 1351, 1352, 1353 and the inner end of the vane slot 1342*a*, 1342*b*, 1342*c*. The back pressure chambers 1343*a*, 1343*b*, 1343*c* may be communicable with first and second main back pressure pockets 1315*a*, 1315*b* and first and second sub back pressure pockets 1325*a*, 1325*b*, which will be described hereinafter, to receive back pressures from the first and second main back pressure pockets 1315*a*, 1315*b* and the first and second sub back pressure pockets 1325*a*, 1325*b* in such a manner that front end surfaces 1351*a*, 1352*a*, 1353*a* of the vanes 1351, 1352, 1353 may be disposed to be in contact with the inner periphery of the cylinder 133 or to be spaced apart from the inner periphery of the cylinder 133 by a predetermined distance.

At least a portion of the back pressure chamber 1343*a*, 1343*b*, 1343*c* may be defined as an arc surface, and a diameter of the arc surface of the back pressure chamber 1343*a*, 1343*b*, 1343*c* may be smaller than a distance between the first and second main back pressure pockets 1315*a*, 1315*b*. Due to this, when communicating with the first main back pressure pocket 1315*a* at high pressure by a discharge back pressure to receive the discharge back pressure while at the same time communicating with the second main back pressure pocket 1315*b*, an intermediate pressure of the second main back pressure pocket 1315*b* may be received as well to prevent a back pressure at rear ends of the vanes 1351, 1352, 1353 from being excessively increased.

In FIG. 3, an example is illustrated in which the back pressure chamber 1343*a*, 1343*b*, 1343*c* is connected to the vane slot 1342*a*, 1342*b*, 1342*c* while having an arc surface, and a diameter of the arc surface of the back pressure chamber 1343*a*, 1343*b*, 1343*c* is smaller than a distance between the first and second main back pressure pockets 1315*a*, 1315*b*. For example, when a high back pressure is received from the first main back pressure pocket 1315*a* and the first sub back pressure pocket 1325*a*, the vane 1351, 1352, 1353 may be maximally drawn out such that front end surface 1351*a*, 1352*a*, 1353*a* of the vane 1351, 1352, 1353 comes into contact with the inner periphery of the cylinder 133, and when an intermediate back pressure is received from the second main back pressure pocket 1315*b* and the second sub back pressure pocket 1325*b*, the vane 1351, 1352, 1353 may be drawn out in a relatively small amount such that the front end surface 1351*a*, 1352*a*, 1353*a* of the vane 1351, 1352, 1353 is spaced apart from the inner periphery of the cylinder 133 by a predetermined distance.

Until the front end surface 1351*a*, 1352*a*, 1353*a* of the vane 1351, 1352, 1353 is adjacent to the suction port 1331 of the cylinder 133 such that high-pressure refrigerant at the front end surface 1351*a*, 1352*a*, 1353*a* of the vane 1351, 1352, 1353 is bypassed to the suction port 1331, the back pressure pocket 1315*a*, 1315*b*, 1325*a*, 1325*b* is in communication with the back pressure chamber 1343*a*, 1343*b*, 1343*c* to allow the front end surface 1351*a*, 1352*a*, 1353*a* of the vane 1351, 1352, 1353 to come into contact with the inner periphery of the cylinder 133, and thus, a predetermined back pressure within the back pressure pocket 1315*a*, 1315*b*, 1325*a*, 1325*b* pressurizes a rear end of the vane 1351, 1352, 1353 through the back pressure chamber 1343*a*, 1343*b*, 1343*c*, and the front end surface 1351*a*, 1352*a*, 1353*a* of the vane 1351, 1352, 1353 comes into contact with the inner periphery of the cylinder 133 while pressurizing the same.

According to one embodiment, an example in which the back pressure pockets 1315*a*, 1315*b*, 1325*a*, 1325*b* are provided in both the main bearing 131 and the sub bearing 132 will be described. In addition, one or more back pressure pockets 1315*a*, 1315*b*, 1325*a*, 1325*b* may be disposed in each of the main bearing 131 and the sub bearing 132, and according to one embodiment, an example in which two back pressure pockets are defined in each of the main bearing 131 and the sub bearing 132 will be described.

However, embodiments are not necessarily limited to this structure, and the back pressure pockets 1315*a*, 1315*b*, 1325*a*, 1325*b* may be provided only in the main bearing 131, and further, one or three of the back pressure pockets 1315*a*, 1315*b*, 1325*a*, 1325*b* may be defined in each of the main bearing 131 and the sub bearing 132.

The main bearing 131 may include main plate portion 1311 coupled to the cylinder 133 to cover an upper side of the cylinder 133. In addition, the sub bearing 132 may include sub plate portion 1321 coupled to the cylinder 133 to cover a lower side of the cylinder 133.

The back pressure pockets may include first and second main back pressure pockets 1315*a*, 1315*b* spaced apart from each other at a predetermined distance from a lower surface of the main plate 1311 of the main bearing 131. In addition, the back pressure pockets 1315*a*, 1315*b*, 1325*a*, 1325*b* may further include first and second sub back pressure pockets 1325*a*, 1325*b* spaced apart from each other at a predetermined distance from an upper surface of the sub bearing 132.

A detailed configuration of the first and second main back pressure pockets 1315*a*, 1315*b* and the first and second sub back pressure pockets 1325*a*, 1325*b* will be described hereinafter.

When the back pressure pocket 1315*a*, 1315*b*, 1325*a*, 1325*b* is not in communication with the back pressure chamber 1343*a*, 1343*b*, 1343*c* until high-pressure refrigerant on the front end surface 1351*a*, 1352*a*, 1353*a* of the vane 1351, 1352, 1353 is bypassed to the suction port 1331, a pressure at a rear end of the vane 1351, 1352, 1353 may be lowered to momentarily push the vane 1351, 1352, 1353 back by a force pushed to the rear end and then a chattering phenomenon in which the front end surface 1351*a*, 1352*a*, 1353*a* of the vane 1351, 1352, 1353 strikes near the suction port 1331 of the cylinder 133 may occur. Due to the chattering phenomenon, there is a problem in that the efficiency of the rotary compressor 100 is lowered and a reliability issue is generated.

The rotary compressor 100 according to one embodiment may have a structure capable of maintaining a high-pressure back pressure at the rear end of the vane 1351, 1352, 1353 described hereinafter, thereby maintaining a discharge back pressure so as not to push the vane 1351, 1352, 1353 back until accumulated high-pressure refrigerant is bypassed to the suction port 1331 on a side surface of the cylinder 133. On the other hand, it may be understood that the compression unit 130 is configured to include the cylinder 133, the roller 134, the plurality of vanes 1351, 1352, 1353, the main bearing 131, and the sub bearing 132. The main bearing 131 and the sub bearing 132 are provided at both upper and lower sides of the cylinder 133, respectively, to constitute the compression space V together with the cylinder 133, the roller 134 is rotatably provided in the compression space V, the vanes 1351, 1352, 1353 are slidably inserted into the roller 134, the plurality of vanes 1351, 1352, 1353 respectively come into contact with the inner periphery of the cylinder 133, and the compression space V is partitioned into a plurality of compression chambers.

Referring to FIGS. 1 to 3, the main bearing 131 may be fixedly provided at the intermediate shell 111 of the casing 110. For example, the main bearing 131 may be, for example, inserted into and welded to the intermediate shell 111.

The main bearing 131 may be closely coupled to an upper end of the cylinder 133. Accordingly, the main bearing 131 may define an upper surface of the compression space V, and support an upper surface of the roller 134 in an axial direction, and at the same time support an upper half portion of the rotational shaft 123 in a radial direction.

The main bearing 131 may include the main plate portion 1311. The main plate portion 1311 may be coupled to the cylinder 133 to cover an upper side of the cylinder 133. The main bearing 131 may further include the main bush portion 1312.

The main bush portion 1312 may extend from a center of the main plate portion 1311 in an axial direction toward the drive motor 120 to support the upper half portion of the rotational shaft 123.

The main plate portion 1311 may be defined in a disk shape, and an outer peripheral surface of the main plate portion 1311 may be closely fixed to an inner peripheral surface of the intermediate shell 111. At least one discharge port 1313*a*, 1313*b*, 1313*c* may be disposed in the main plate portion 1311, a plurality of discharge valves 1361, 1362, 1363 may be provided at an upper surface of the main plate portion 1311 to open and close each discharge port 1313*a*, 1313*b*, 1313*c*, and a discharge muffler 137 having a discharge space (no reference numeral) may be provided at an upper side of the main plate portion 1311 to accommodate the discharge ports 1313*a*, 1313*b*, 1313*c* and the discharge valves 1361, 1362, 1363. The discharge ports 1313*a*, 1313*b*, 1313*c* will be described hereinafter.

Figure 5:
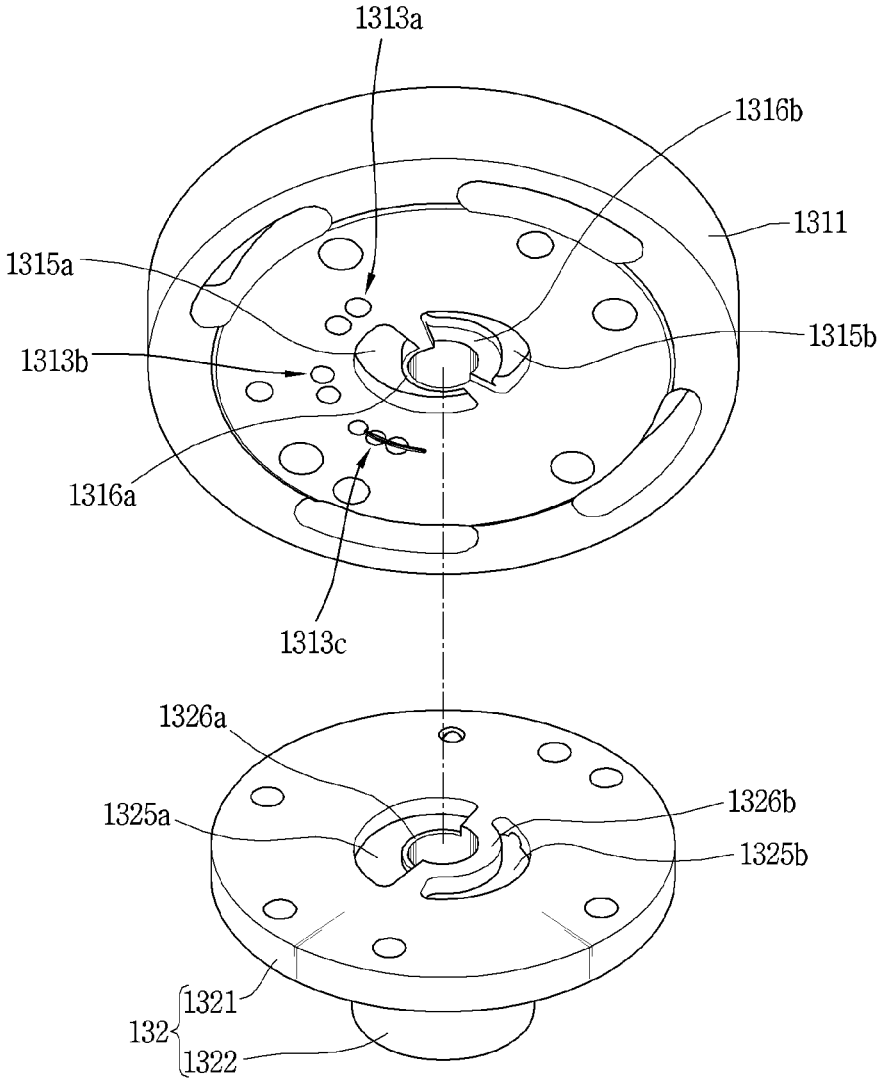
FIG. 5 is a perspective view of a bottom portion of a main bearing and an upper portion of a sub bearing, respectively, according to an embodiment.
Figure 6:
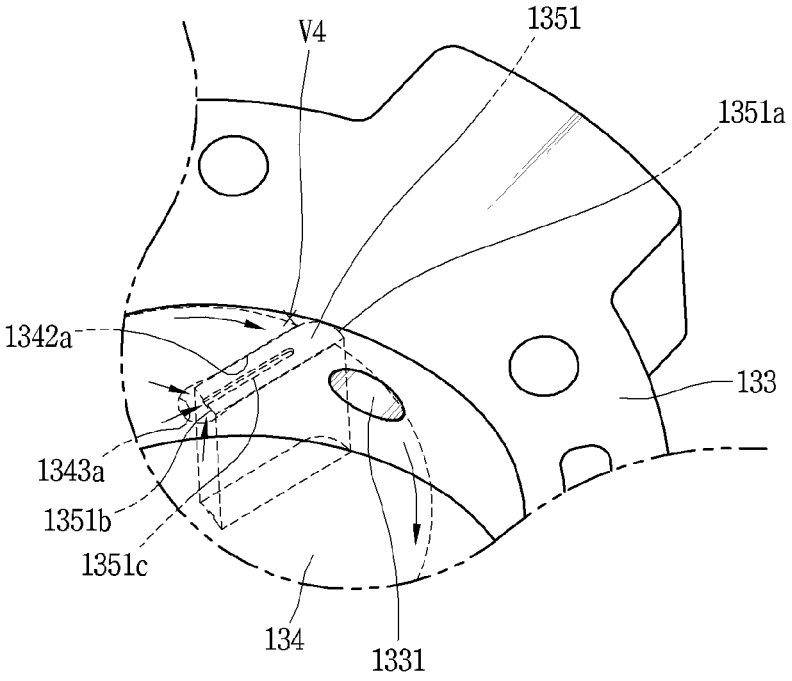
FIG. 6 is a perspective view showing an example in which a discharging back pressure is maintained such that a front end surface of a vane is disposed adjacent to a suction port of a cylinder according to an embodiment.
Figure 7:
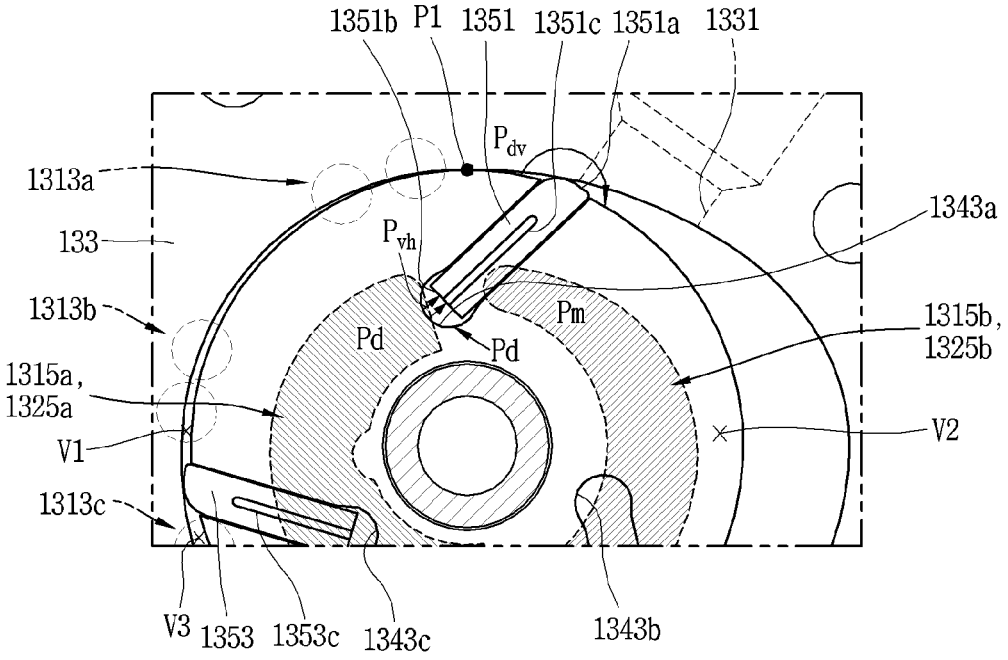
FIG. 7 is an enlarged view of portion A in FIG. 3 showing an example in which a discharge back pressure is maintained when a front end surface of a vane is adjacent to a suction port.
Figure 8:
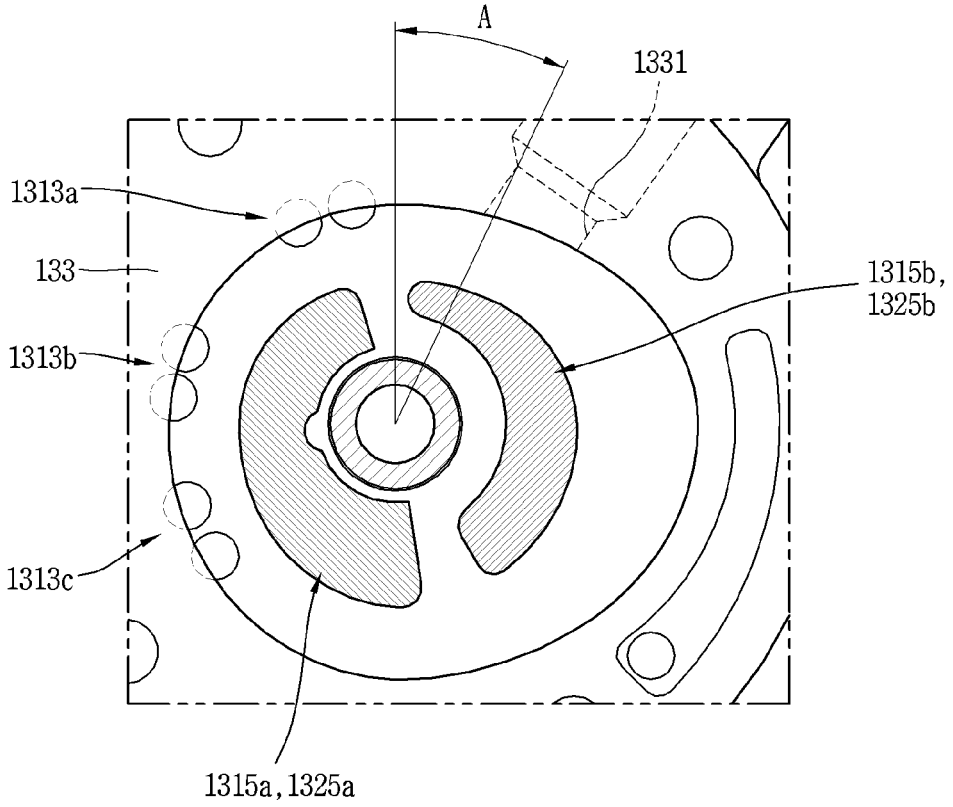
FIG. 8 is a conceptual view showing a pressure section at a front end of the vane and a pressure section at a rear end of the vane.
Figure 9:
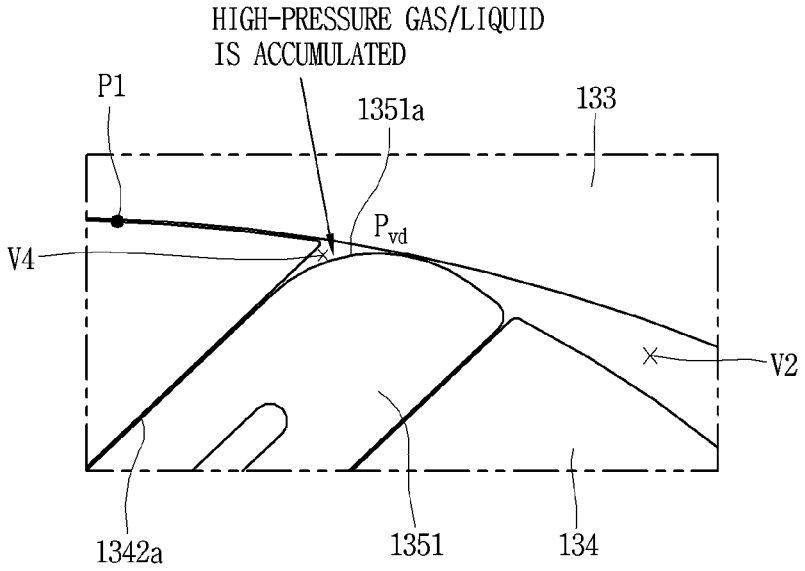
FIG. 9 is an enlarged sectional view showing a dead volume in which high-pressure refrigerant is accommodated in a front end surface of the vane, a contact point between a rotor and the cylinder, and an inner periphery of the cylinder.
Figure 10A:
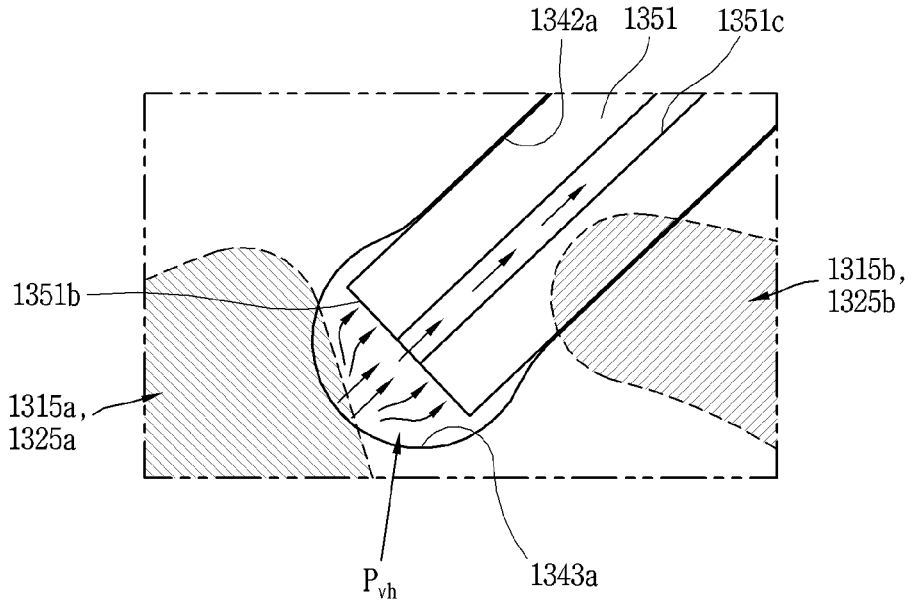
FIG. 10A is a conceptual view showing an acting force by a discharge pressure applied to a rear end of the vane when the front end surface of the vane is disposed adjacent to the contact point of the cylinder.
Figure 10B:
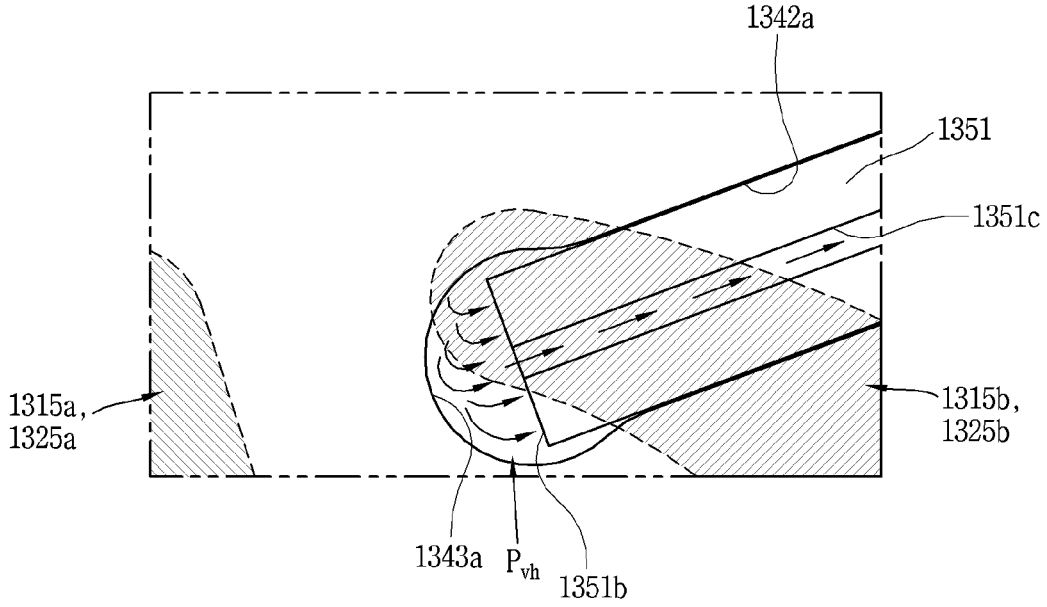
FIG. 10B is a conceptual view showing an acting force by an intermediate pressure applied to the rear end of the vane when the front end surface of the vane is disposed adjacent to the contact point of the cylinder.

FIG. 5 is a perspective view of a bottom portion of a main bearing and an upper portion of a sub bearing, respectively. FIG. 6 is a perspective view showing an example in which a discharge back pressure is maintained such that a front end surface of a vane is disposed adjacent to the suction port of the cylinder. FIG. 7 is a conceptual view showing an example in which the discharge back pressure is maintained when a front end surface of a vane is disposed adjacent to a suction port. Further, FIG. 8 is a conceptual view showing a pressure section at a front end of the vane and a pressure section at a rear end of the vane. FIG. 9 is an enlarged sectional view showing a dead volume in which high-pressure refrigerant is accommodated in a front end surface of the vane a contact point between a rotor and the cylinder, and an inner periphery of the cylinder. FIG. 10A is a conceptual view showing an acting force by a discharge pressure applied to a rear end of the vane when the front end surface of the vane is disposed adjacent to the contact point of the cylinder, and FIG. 10B is a conceptual view showing an acting force by an intermediate pressure applied to the rear end of the vane when the front end surface of the vane is disposed adjacent to the contact point of the cylinder.

In FIG. 5, only the main bearing 131 and the sub bearing 132 are shown, but the configuration of the roller 134 and the cylinder 133 are not shown in order to show a bottom portion of the main bearing 131 and an upper portion of the sub bearing 132 in FIG. 4. Referring to FIG. 5, first main back pressure pocket 1315*a* and second main back pressure pocket 1315*b* may be disposed on a lower surface of the main plate portion 1311 facing an upper surface of the roller 134 between both axial side surfaces of the main plate portion 1311.

The first main back pressure pocket 1315*a* and the second main back pressure pocket 1315*b* may be defined in an arc shape and disposed at a predetermined interval along a circumferential direction. Inner peripheral surfaces of the first main back pressure pocket 1315*a* and the second main back pressure pocket 1315*b* may be defined in a circular shape, but outer peripheral surfaces thereof may be defined in an elliptical shape in consideration of the vane slots 1342*a*, 1342*b*, 1342*c* described hereinafter.

In addition, referring to FIGS. 5 and 7, an example of the first main back pressure pocket 1315*a* having a relatively wide width and the second main back pressure pocket 1315*b* having a relatively narrow width is shown, and an example in which both inner peripheral surfaces of the first and the second main back pressure pockets 1315*a*, 1315*b* are defined in a circular shape, and outer peripheral surfaces thereof are defined in an elliptical shape is shown; however, embodiments are not necessarily limited to this structure. In addition, the first main back pressure pocket 1315*a* may accommodate high-pressure refrigerant to provide a high back pressure to a rear end of the vane 1351, 1352, 1353, and the second main back pressure pocket 1315*b* may accommodate intermediate-pressure refrigerant to provide an intermediate back pressure to the rear end of the vane 1351, 1352, 1353.

The first main back pressure pocket 1315*a* and the second main back pressure pocket 1315*b* may be defined within an outer diameter range of the roller 134. Accordingly, the first main back pressure pocket 1315*a* and the second main back pressure pocket 1315*b* may be separated from the compression space V.

A back pressure in the first main back pressure pocket 1315*a* may be greater than that in the second main back pressure pocket 1315*b*. That is, the first main back pressure pocket 1315*a* may be provided in a vicinity of the discharge ports 1313*a*, 1313*b*, 1313*c* to provide a discharge back pressure. Further, the second main back pressure pocket 1315*b* may define an intermediate pressure between the suction pressure and the discharge pressure.

In the first main back pressure pocket 1315*a*, oil (refrigerant oil) may pass through a fine passage between a first main bearing protrusion 1316*a* and an upper surface 134*a* of the roller 134, which will be described hereinafter, to flow into the first main back pressure pocket 1315*a*. The second main back pressure pocket 1315*b* may be defined within a range of the compression chamber defining an intermediate pressure in the compression space V. Accordingly, the second main back pressure pocket 1315*b* maintains an intermediate pressure.

The second main back pressure pocket 1315*b* defines an intermediate pressure that is a pressure lower than that of the first main back pressure pocket 1315*a*. In the second main back pressure pocket 1315*b*, oil flowing into the main bearing hole 1312*a* of the main bearing 131 through the first oil through hole 126*a* may flow into the second main back pressure pocket 1315*b*. The second main back pressure pocket 1315*b* may be defined within a range of the compression chamber V2 defining a suction pressure in the compression space V. Accordingly, the second main back pressure pocket 1315*b* maintains the suction pressure.

In addition, on inner peripheral sides of the first main back pressure pocket 1315*a* and the second main back pressure pocket 1315*b*, respectively, the first main bearing protrusion 1316*a* and the second main bearing protrusion 1316*b* may be disposed to extend from the main bearing surface 1312*b* of the main bush portion 1312. Accordingly, the first main back pressure pocket 1315*a* and the second main back pressure pocket 1315*b* may be sealed to the outside, and at the same time, the rotational shaft 123 may be stably supported.

The first main bearing protrusion 1316*a* and the second main bearing protrusion 1316*b* may be disposed at a same height, and an oil communication groove (not shown) or an oil communication hole (not shown) may be disposed on an inner peripheral end surface of the second main bearing protrusion 1316*b*. Alternatively, an inner peripheral height of the second main bearing protrusion 1316*b* may be disposed to be lower than that of the first main bearing protrusion 1316*a*. Accordingly, high-pressure oil (refrigerant oil) flowing into the main bearing surface 1312*b* may flow into the first main back pressure pocket 1315*a*. The first main back pressure pocket 1315*a* defines a higher pressure (discharge pressure) than the second main back pressure pocket 1315*b*.

The main bush portion 1312 may be disposed in a hollow bush shape, and a first oil groove 1312*c* may be disposed on an inner peripheral surface of the main bearing hole 1312*a* constituting an inner peripheral surface of the main bush portion 1312. The first oil groove 1312*c* may be defined, for example, in an oblique or spiral shape between upper and lower ends of the main bush portion 1312 such that the lower end thereof communicates with the first oil through hole 126*a*.

In FIG. 4, an example is shown in which the main bush portion 1312 is defined in an upward direction in a hollow bush shape on the main plate 1311, and the oil groove 1312*c* is defined in an oblique direction on an inner peripheral surface of the main bearing hole 1312*a* constituting an inner peripheral surface of the main bush portion 1312. Although not shown in the drawings, an oil groove may be defined in a diagonal or spiral shape on an outer peripheral surface of the rotational shaft 123, that is, an outer peripheral surface of the main bearing portion 123*b*.

Referring to FIGS. 1 and 2, the sub bearing 132 may be closely coupled to a lower end of the cylinder 133. Accordingly, the sub bearing 132 may define a lower surface of the compression space V, and support a lower surface of the roller 134 in the axial direction, and at the same time support a lower half portion of the rotational shaft 123 in the radial direction.

Referring to FIGS. 2 and 4, the sub bearing 132 may include the sub plate portion 1321. The sub plate portion 1321 may be coupled to the cylinder 133 to cover a lower side of the cylinder 133.

In addition, the sub bearing 132 may further include the sub bush portion 1322. The sub bush portion 1322 may extend from a center of the sub plate portion 1321 in the axial direction toward the lower shell 112 to support a lower half portion of the rotational shaft 123.

The sub plate portion 1321 may be defined, for example, in a disk shape similar to that of the main plate portion 1311, and an outer peripheral surface of the sub plate portion 1321 may be spaced apart from an inner peripheral surface of the intermediate shell 111. A first sub back pressure pocket 1325*a* and a second sub back pressure pocket 1325*b* may be disposed on an upper surface of the sub plate portion 1321 facing a lower surface of the roller 134 between axial side surfaces of the sub plate portion 1321. The first sub back pressure pocket 1325*a* and the second sub back pressure pocket 1325*b* may be disposed to be symmetrical with respect to the first main back pressure pocket 1315*a* and the second main back pressure pocket 1315*b*, respectively, described above around the roller 134.

Referring to FIGS. 4 and 5, an example of the first sub back pressure pocket 1325*a* having a relatively wide width and the second sub back pressure pocket 1325*b* having a relatively narrow width is shown, and an example in which both inner peripheral surfaces of the first and the second sub back pressure pockets 1325*a*, 1325*b* are defined in a circular shape, and outer peripheral surfaces thereof are defined in an elliptical shape is shown; however, embodiments are not necessarily limited to this structure.

In addition, the first sub back pressure pocket 1325*a* may accommodate high-pressure refrigerant to provide a high back pressure to a rear end of the vane 1351, 1352, 1353, and the second sub back pressure pocket 1325*b* may accommodate intermediate-pressure refrigerant to provide an intermediate back pressure to the rear end of the vane 1351, 1352, 1353. Further, the first and second sub back pressure pockets 1325*a*, 1325*b* may be defined in a shape corresponding to the first and second main back pressure pockets 1315*a*, 1315*b*, respectively.

For example, the first sub back pressure pocket 1325*a* may be disposed to be symmetrical with respect to the first main back pressure pocket 1315*a* with the roller 134 interposed therebetween, and the second sub back pressure pocket 1325*b* to be symmetrical with respect to the second main back pressure pocket 1315*b* with the roller 134 interposed therebetween.

A first sub bearing protrusion 1326*a* may be disposed on an inner peripheral side of the first sub back pressure pocket 1325*a*, and a second sub bearing protrusion 1326*b* may be disposed on an inner peripheral side of the second sub back pressure pocket 1325*b*, respectively. However, in some cases, the first sub back pressure pocket 1325*a* and the second sub back pressure pocket 1325*b* may be disposed to be asymmetrical with respect to the first main back pressure pocket 1315*a* and the second main back pressure pocket 1315*b*, respectively, around the roller 134. For example, the first sub back pressure pocket 1325*a* and the second sub back pressure pocket 1325*b* may be disposed to have different depths from those of the first main back pressure pocket 1315*a* and the second main back pressure pocket 1315*b*.

In addition, an oil supply hole (not shown) may be disposed between the first sub back pressure pocket 1325*a* and the second sub back pressure pocket 1325*b*, more precisely, between the first sub bearing protrusion 1326*a* and the second sub bearing protrusion 1326*b* or at a portion where the first sub bearing protrusion 1326*a* and the second sub bearing protrusion 1326*b* are connected to each other.

For example, a first end constituting an inlet of the oil supply hole (not shown) may be disposed to be submerged in the oil storage space 110*b*, and a second end constituting an outlet of the oil supply hole may be disposed to be positioned on a rotational path of the back pressure chambers 1343*a*, 1343*b*, 1343*c* on an upper surface of the sub plate portion 1321 facing a lower surface of the roller 134 to be described hereinafter. Accordingly, during rotation of the roller 134, high-pressure oil stored in the oil storage space 110*b* may be periodically supplied to the back pressure chambers 1343*a*, 1343*b*, 1343*c* through the oil supply hole (not shown) while the back pressure chambers 1343*a*, 1343*b*, 1343*c* periodically communicate with the oil supply hole (not shown), and through this, each of the vanes 1351, 1352, 1353 may be stably supported toward the inner peripheral surface 1332 of the cylinder 133.

The sub bush portion 1322 may have a hollow bush shape, and a second oil groove 1322*c* may be disposed on an inner peripheral surface of the sub bearing hole 1322*a* constituting an inner peripheral surface of the sub bush portion 1322. The second oil groove 1322*c* may be, for example, defined in a straight line or an oblique line between upper and lower ends of the sub bush portion 1322 such that the upper end thereof communicates with the second oil through hole 126*b* of the rotational shaft 123.

Although not shown in the drawings, an oil groove may be defined in a diagonal or spiral shape on an outer peripheral surface of the rotational shaft 123, that is, an outer peripheral surface of a sub bearing portion 123*c*. In addition, although not shown in the drawings, the back pressure pockets 1315*a*, 1315*b*, 1325*a*, 1325*b* may be disposed in only one of the main bearing 131 and the sub bearing 132.

The discharge ports 1313*a*, 1313*b*, 1313*c* may be disposed in the main bearing 131 as described above. However, the discharge ports 1313*a*, 1313*b*, 1313*c* may be disposed in the sub bearing 132 or may be disposed in the main bearing 131 and the sub bearing 132, respectively, and disposed to pass through between inner and outer peripheral surfaces of the cylinder 133. This embodiment will be mainly described with respect to an example in which the discharge ports 1313*a*, 1313*b*, 1313*c* are disposed in the main bearing 131.

Only one discharge port 1313*a*, 1313*b*, 1313*c* may be provided. However, in the discharge ports 1313*a*, 1313*b*, 1313*c* according to this embodiment, the plurality of the discharge ports 1313*a*, 1313*b*, 1313*c* may be disposed at a predetermined interval along a compression advancing direction (or a rotational direction of the roller 134, a clockwise direction indicated by an arrow on the roller 134 in FIG. 3). Referring to FIGS. 3 and 5, an example is shown in which a total of six discharge ports 1313*a*, 1313*b*, 1313*c* in pairs are disposed to pass through the main bearing 131.

In general, in the vane type rotary compressor 100, as the roller 134 is disposed eccentrically with respect to the compression space V, a proximal point P1 almost in contact between outer peripheral surface 1341 of the roller 134 and inner peripheral surface 1332 of the cylinder 133 is generated, and the discharge port 1313*a*, 1313*b*, 1313*c* is disposed in the vicinity of the proximal point P1. Accordingly, as the compression space V approaches the proximal point P1, a distance between the inner peripheral surface 1332 of the cylinder 133 and the outer peripheral surface 1341 of the roller 134 is greatly decreased, thereby making it difficult to secure an area for the discharge port 1313*a*, 1313*b*, 1313*c*. The proximal point P1 may be provided on a center line of an uppermost position of the roller 134 in FIG. 3, shown in FIG. 3, for example, but it is not necessarily limited to this position.

As a result, as in this embodiment, the discharge port 1313*a*, 1313*b*, 1313*c* may be divided into a plurality of discharge ports 1313*a*, 1313*b*, 1313*c* defined along a rotational direction (or compression advancing direction) of the roller 134. Further, the plurality of discharge ports 1313*a*, 1313*b*, 1313*c* may be respectively defined one by one, but may be defined in pairs as in this embodiment.

For example, referring to FIG. 3, an example is shown in which the discharge ports 1313*a*, 1313*b*, 1313*c* according to this embodiment are arranged in the order of the first discharge port 1313*a*, the second discharge port 1313*b*, and the third discharge port 1313*c* from the discharge ports 1313*a*, 1313*b*, 1313*c* disposed relatively far from a proximal portion 1332*a*. According to the example shown in FIG. 3, the plurality of discharge ports 1313*a*, 1313*b*, 1313*c* may communicate with one compression chamber.

Although not shown in the drawings, a first gap between the first discharge port 1313*a* and the second discharge port 1313*b*, a second gap between the second discharge port 1313*b* and the third discharge port 1313*c*, and a third gap between the third discharge port 1313*c* and the first discharge port 1313*a* may be defined to be the same as one another. The first gap, the second gap, and the third gap may be defined to be substantially the same as a circumferential length of the first compression chamber V1, a circumferential length of the second compression chamber V2, and a circumferential length of the third compression chamber V3, respectively.

In addition, the plurality of discharge ports 1313*a*, 1313*b*, 1313*c* may communicate with one compression chamber, and the plurality of compression chambers do not communicate with one discharge port 1313*a*, 1313*b*, 1313*c*, but the first discharge port 1313*a* may communicate with the first compression chamber V1, the second discharge port 1313*b* with the second compression chamber V2, and the third discharge port 1313*c* with the third compression chamber V3, respectively. However, unlike this embodiment, when the vane slots 1342*a*, 1342*b*, 1342*c* are defined at unequal intervals, the circumferential length of each compression chamber V1, V2, V3 may be defined to be different, and a plurality of compression ports 1313*a*, 1313*b*, 1313*c* may communicate with one compression chamber or a plurality of compression chambers may communicate with one discharge port 1313*a*, 1313*b*, 1313*c*.

In addition, referring to FIG. 3, a discharge groove 1314 may be disposed to extend to the discharge port 1313*a*, 1313*b*, 1313*c* according to this embodiment. The discharge groove 1314 may extend, for example, in an arc shape along a compression advancing direction (rotational direction of the roller 134). Accordingly, refrigerant that is not discharged from a preceding compression chamber may be guided to the discharge port 1313*a*, 1313*b*, 1313*c* communicating with a subsequent compression chamber through the discharge groove 1314 to be discharged together with the refrigerant compressed in the subsequent compression chamber. Through this, residual refrigerant in the compression space V may be minimized to suppress over-compression, thereby improving compressor efficiency.

The discharge groove 1314 as described above may be disposed to extend from the final discharge port 1313*a*, 1313*b*, 1313*c*, that is, the third discharge port 1313*c*. In general, in the vane type rotary compressor 100, the compression space V may be partitioned into a suction chamber and a discharge chamber at both sides with the proximal portion (proximal point) 1332*a* interposed therebetween, and the discharge port 1313*a*, 1313*b*, 1313*c* is unable to overlap the proximal point P1 positioned in the proximal portion 1332*a* in consideration of sealing between the suction chamber and discharge chamber. Accordingly, between the proximal point P1 and the discharge ports 1313*a*, 1313*b*, 1313*c*, a residual space spaced apart between the inner peripheral surface 1332 of the cylinder 133 and the outer peripheral surface 1341 of the roller 134 is defined along a circumferential direction, and refrigerant remains in this residual space without being discharged through the final discharge port 1313*a*, 1313*b*, 1313. The residual refrigerant may increase a pressure of the final compression chamber to cause a decrease in compression efficiency due to over-compression.

However, as in this embodiment, when the discharge groove 1314 extends from the final discharge port 1313*a*, 1313*b*, 1313*c* to the residual space, refrigerant remaining in the remaining space may flow backward through the discharge groove 1314 to the final discharge port 1313*a*, 1313*b*, 1313*c* to effectively suppress a decrease in compression efficiency due to over-compression in the final compression chamber due to being further discharged.

Although not shown in the drawings, a residual discharge hole may be disposed in a residual space in addition to the discharge groove 1314. The residual discharge hole may be disposed to have a smaller inner diameter compared to the discharge port 1313*a*, 1313*b*, 1313*c*, and unlike the discharge port 1313*a*, 1313*b*, 1313*c*, the residual discharge hole may always be open without being opened or closed by the discharge valve.

Further, the plurality of discharge ports 1313*a*, 1313*b*, 1313*c* may be opened and closed by respective discharge valves 1361, 1362, 1363 described above. Each of the discharge valves 1361, 1362, 1363 may be configured with a cantilevered reed valve having one end constituting a fixed end and the other end constituting a free end. As each of these discharge valves 1361, 1362, 1363 is widely known in the rotary compressor 100 in the related art, description thereof has been omitted.

Referring to FIGS. 1 to 3, the cylinder 133 according to this embodiment may be in close contact with a lower surface of the main bearing 131 and, for example, bolt-fastened to the main bearing 131 together with the sub bearing 132. As described above, as the main bearing 131 is fixedly coupled to the casing 110, the cylinder 133 may be fixedly coupled to the casing 110 by the main bearing 131.

The cylinder 133 may be defined in an annular shape having an empty space portion to form the compression space V in the center. The empty space portion may be sealed by the main bearing 131 and the sub bearing 132 to form the above-described compression space V, and the roller 134 may be rotatably coupled to the compression space V.

Referring to FIGS. 1 and 2, the cylinder 133 may be defined such that the suction port 1331 passes through inner and outer peripheral surfaces thereof. However, unlike FIG. 2, the suction port 1331 may be disposed to pass through inner and outer peripheral surfaces of the main bearing 131 or the sub bearing 132.

The suction port 1331 may be disposed at one side in a circumferential direction around the proximal point P1 described hereinafter. The discharge ports 1313*a*, 1313*b*, 1313*c* described above may be disposed in the main bearing 131 at the other side in a circumferential direction opposite to the suction port 1331 around the proximal point P1.

The inner peripheral surface 1332 of the cylinder 133 may be defined in an elliptical shape. The inner peripheral surface 1332 of the cylinder 133 according to this embodiment may be defined in an asymmetric elliptical shape by combining a plurality of ellipses, for example, four ellipses having different major and minor ratios to have two origins. More specifically, the inner peripheral surface 1332 of the cylinder 133 according to this embodiment may be defined to have a first origin Or, which is a rotational center of the roller 134 (an axial center or an outer diameter center of the cylinder 133), and a second origin O' that is biased toward a distal portion 1332*b* with respect to the first origin Or.

The X-Y plane defined around the first origin Or defines third and fourth quadrants, and the X-Y plane defined around the second origin O' defines first and second quadrants. The third quadrant is defined by the third ellipse, the fourth quadrant by the fourth ellipse, respectively, and the first quadrant may be defined by the first ellipse, and the second quadrant by the second ellipse, respectively.

In addition, the inner peripheral surface 1332 of the cylinder 133 according to this embodiment may include a proximal portion 1332*a*, a distal portion 1332*b*, and a curved portion 1332*c*. The proximal portion 1332*a* is a portion closest to an outer peripheral surface of the roller 134 (or the rotational center Or of the roller 134), the distal portion 1332*b* is a portion farthest from the outer peripheral surface 1341 of the roller 134, and the curved portion 1332*c* is a portion connecting the proximal portion 1332*a* and the distal portion 1332*b*.

Referring to FIGS. 3 and 4, the roller 134 may be rotatably provided in the compression space V of the cylinder 133, and the plurality of vanes 1351, 1352, 1353 may be inserted at a predetermined interval into the roller 134 along a circumferential direction. Accordingly, compression chambers as many as the number of the plurality of vanes 1351, 1352, 1353 may be partitioned and defined in the compression space V. In this embodiment, an example will be mainly described in which the plurality of vanes 1351, 1352, 1353 are made up of three and the compression space V are partitioned into three compression chambers.

The roller 134 according to this embodiment has an outer peripheral surface 1341 defined in a circular shape, and the rotational shaft 123 may be extended as a single body or may be post-assembled and combined therewith at the rotational center Or of the roller 134. Accordingly, the rotational center Or of the roller 134 is coaxially positioned with respect to an axial center (unsigned) of the rotational shaft 123, and the roller 134 rotates concentrically together with the rotational shaft 123.

However, as described above, as the inner peripheral surface 1332 of the cylinder 133 is defined in an asymmetric elliptical shape biased in a specific direction, the rotational center Or of the roller 134 may be eccentrically disposed with respect to an outer diameter center Oc of the cylinder 133. Accordingly, in the roller 134, one side of the outer peripheral surface 1341 is almost in contact with the inner peripheral surface 1332 of the cylinder 133, precisely, the proximal portion 1332*a* to define the proximal point P1.

The proximal point P1 may be defined in the proximal portion 1332*a* as described above. Accordingly, an imaginary line passing through the proximal point P1 may correspond to a major axis of an elliptical curve defining the inner peripheral surface 1332 of the cylinder 133.

In addition, the roller 134 may have a plurality of vane slots 1342*a*, 1342*b*, 1342*c* disposed to be spaced apart from one another along a circumferential direction on the outer peripheral surface 1341 thereof. The plurality of vanes 1351, 1352, 1353 described hereinafter may be slidably inserted into and coupled to the vane slots 1342*a*, 1342*b*, 1342*c*, respectively.

Referring to FIG. 4, in the plurality of vane slots 1342*a*, 1342*b*, 1342*c*, first vane slot 1342*a*, second vane slot 1342*b*, and third vane slot 1342*c* are shown along a compression advancing direction (a rotational direction of the roller 134, indicated by a clockwise arrow on the roller 134 in FIG. 3). The first vane slot 1342*a*, the second vane slot 1342*b*, and the third vane slot 1342*c* may be defined to have a same width and depth as one another at equal or unequal intervals along a circumferential direction, and an example is shown in which they are disposed to be spaced apart at equal intervals in the present disclosure.

For example, the plurality of vane slots 1342*a*, 1342*b*, 1342*c* may be respectively disposed to be inclined by a predetermined angle with respect to a radial direction so as to sufficiently secure lengths of the vanes 1351, 1352, 1353. Accordingly, when the inner peripheral surface 1332 of the cylinder 133 is defined in an asymmetric elliptical shape, even though a distance from the outer peripheral surface 1341 of the roller 134 to the inner peripheral surface 1332 of the cylinder 133 increases, the vanes 1351, 1352, 1353 may be suppressed from being released from the vane slots 1342*a*, 1342*b*, 1342*c*, thereby increasing a degree of freedom in designing the inner peripheral surface 1332 of the cylinder 133.

Allowing a direction in which the vane slot 1342*a*, 1342*b*, 1342*c* is inclined to be an opposite direction to a rotational direction of the roller 134, that is, allowing the front end surface 1351*a*, 1352*a*, 1353*a* of each vane 1351, 1352, 1353 in contact with the inner peripheral surface 1332 of the cylinder 133 to be inclined toward a rotational direction of the roller 134 may be advantageous because compression start angle may be pulled toward the rotational direction of the roller 134 to quickly start compression.

The back pressure chambers 1343*a*, 1343*b*, 1343*c* may be disposed to communicate with one another at inner ends of the vane slots 1342*a*, 1342*b*, 1342*c*. The back pressure chamber 1343*a*, 1343*b*, 1343*c* may be a space in which refrigerant (oil) at a discharge pressure or intermediate pressure is accommodated toward a rear side of each vane 1351, 1352, 1353, that is, the rear end surface 1351*b*, 1352*b*, 1353*b* of the vane 1351, 1352, 1353, and the each vane 1351, 1352, 1353 may be pressurized toward an inner peripheral surface of the cylinder 133 by a pressure of the refrigerant (or oil) filled in the back pressure chamber 1343*a*, 1343*b*, 1343*c*. For convenience, hereinafter, a direction toward the cylinder 133 with respect to a movement direction of the vane 1351, 1352, 1353 is defined as a front side, and an opposite side thereto as a rear side.

The back pressure chamber 1343*a*, 1343*b*, 1343*c* may be disposed to be sealed by the main bearing 131 and the sub bearing 132 at upper and lower ends thereof, respectively. The back pressure chambers 1343*a*, 1343*b*, 1343*c* may communicate independently with respect to each of the back pressure pockets 1315*a*, 1315*b*, 1325*a*, 1325, and may be disposed to communicate with one another by the back pressure pockets 1315*a*, 1315*b*, 1325*a*, 1325*b*.

In addition, as described above, at least a portion of the back pressure chambers 1343*a*, 1343*b*, 1343*c* may be defined as an arc surface, and a diameter of the arc surface of the back pressure chambers 1343*a*, 1343*b*, 1343*c* may be smaller than a distance between the first and second main back pressure pockets 1315*a*, 1315*b*. Due to this, when communicating with the first main back pressure pocket 1315*a* at high pressure by a discharge back pressure to receive the discharge back pressure while at the same time communicating with the second main back pressure pocket 1315*b*, an intermediate pressure of the second main back pressure pocket 1315*b* may be received as well to prevent a back pressure at rear ends of the vanes 1351, 1352, 1353 from being excessively increased.

In FIGS. 3 and 7, an example is shown in which the back pressure chamber 1343*a*, 1343*b*, 1343*c* is connected to the vane slot 1342*a*, 1342*b*, 1342*c* while having an arc surface, and a diameter of the arc surface of the back pressure chamber 1343*a*, 1343*b*, 1343*c* is smaller than a distance between the first and second main back pressure pockets 1315*a*, 1315*b*. Referring to FIGS. 3 and 4, the plurality of vanes 1351, 1352, 1353 according to this embodiment may be slidably inserted into the vane slots 1342*a*, 1342*b*, 1342*c*, respectively. Accordingly, the plurality of vanes 1351, 1352, 1353 may be defined to have substantially the same shape as the vane slots 1342*a*, 1342*b*, 1342*c*, respectively.

For example, the plurality of vanes 1351, 1352, 1353 may be defined as first vane 1351, second vane 1352, and third vane 1353 along a rotational direction of the roller 134. The first vane 1351 may be inserted into the first vane slot 1342*a*, the second vane 1352 into the second vane slot 1342*b*, and the third vane 1353 into the third vane slot 1342*c*, respectively, and such a configuration is shown in FIGS. 3 and 4.

The plurality of vanes 1351, 1352, and 1353 may all have the same shape. More specifically, each of the plurality of vanes 1351, 1352, 1353 may be defined as a substantially rectangular parallelepiped, the front end surface 1351*a*, 1352*a*, 1353*a* in contact with the inner peripheral surface 1332 of the cylinder 133 may be defined as a curved surface, and the rear end surface 1351*b*, 1352*b*, 1353*b* facing the respective back pressure chamber 1343*a*, 1343*b*, 1343*c* may be defined as a straight surface.

The rear end surfaces 1351*b*, 1352*b*, 1353*b* of the plurality of vanes 1351, 1352, 1353 may include pressurization flow path grooves 1351*c*, 1352*c*, 1353*c* to transmit a back pressure through the back pressure chambers 1343*a*, 1343*b*, 1343*c*. As shown in FIGS. 3 and 4, for example, the pressurization flow path groove 1351*c*, 1352*c*, 1353*c* may have a predetermined width and may be disposed in parallel to an extension direction of the vane 1351, 1352, 1353. Refrigerant or oil may be accommodated in the pressurization flow path groove 1351*c*, 1352*c*, 1353*c* to transmit a back pressure to the vane 1351, 1352, 1353. When the pressurization flow path grooves 1351*c*, 1352*c*, 1353*c* are disposed in the rear end surfaces 1351*b*, 1352*b*, 1353*b* of the plurality of vanes 1351, 1352, 1353, a back pressure may be transmitted not only through the end surfaces 1351*b*, 1352*b*, 1353*b* of the plurality of vanes 1351, 1352, 1353 but also through the pressurization flow path grooves 1351*c*, 1352*c*, 1353*c* thereof at the same time.

FIGS. 3 and 4, for example, show an example in which the plurality of vanes 1351, 1352, 1353 are provided with the pressurization flow path grooves 1351*c*, 1352*c*, 1353*c*, but the pressurization flow path grooves 1351*c*, 1352*c*, 1353*c* are not essential components, and an example in which the plurality of vanes 1351, 1352, 1353 are not provided with the pressurization flow path grooves 1351*c*, 1352*c*, 1353*c*, and a back pressure is transmitted only through the rear end surfaces 1351*b*, 1352*b*, 1353*b* of the plurality of vanes 1351, 1352, 1353 may of course also be allowed.

In the rotary compressor 100 provided with the hybrid cylinder 133 as described above, when power is applied to the drive motor 120, the rotor 122 of the drive motor 120 and the rotational shaft 123 coupled to the rotor 122 rotate, and the roller 134 coupled to or integrally formed with the rotational shaft 123 rotates together with the rotational shaft 123. Then, the plurality of vanes 1351, 1352, 1353 are drawn out from the respective vane slots 1342*a*, 1342*b*, 1342*c* by a centrifugal force generated by rotation of the roller 134 and a back pressure of the back pressure chamber 1343*a*, 1343*b*, 1343*c* supporting the rear end surface 1351*b*, 1352*b*, 1353*b* of the vane 1351, 1352, 1353 to come into contact with the inner peripheral surface 1332 of the cylinder 133.

The compression space V of the cylinder 133 is partitioned into compression chambers (including suction chambers or discharge chambers) V1, V2, V3 as many as the number of the plurality of vanes 1351, 1352, 1353 by the plurality of vanes 1351, 1352, 1353, a volume of the respective compression chamber V1, V2, V3 is varied by a shape of the inner peripheral surface 1332 of the cylinder 133 and an eccentricity of the roller 134, and refrigerant suctioned into the respective compression chamber V1, V2, V3 is compressed and discharged into an inner space of the casing 110 while moving along the roller 134 and the vane 1351, 1352, 1353. In particular, a back pressure is maintained at a predetermined size to allow the front end surface 1351*a*, 1352*a*, 1353*a* of the vane 1351, 1352, 1353 to come into contact with an inner periphery of the cylinder 133 until high-pressure refrigerant accommodated between one of the plurality of vanes 1351, 1352, 1353 and the inner periphery of the cylinder 133 is bypassed to the suction port 1331.

FIGS. 3 and 6 show an example in which the front end surface 1351*a* of the first vane 1351 starts to come into contact with the cylinder 133 at a side of the suction port 1331, wherein chattering does not occur due to a high-pressure back pressure provided at a rear end of the first vane 1351, the first vane 1351 comes into contact with the inner periphery of the cylinder 133, and high-pressure refrigerant between the front end surfaces 1351*a*, 1352*a*, 1353*a* of the first vane 1351 and the inner circumference of the cylinder 133 is bypassed to the suction port 1331 while the front end surface 1351*a* of the first vane 1351 passes the suction port 1331.

In FIG. 6, an example is shown in which when the roller 134 rotates in a clockwise direction, after the first vane 1351 passes the contact point, high-pressure refrigerant accommodated in a dead volume V4 (shown in FIGS. 6 and 9) is bypassed to the suction port 1331 while communicating with the suction port 1331 of the cylinder 133. At this time, the front end surface 1351*a* of the first vane 1351 comes into contact with the inner periphery of the cylinder 133 while not being pushed back by a high pressure back pressure in the back pressure pockets 1315*a*, 1315*b*, 1325*a*, 1325*b* communicating with the first main back pressure pocket 1315*a* and the first sub back pressure pocket 1325*a*.

As described above, when liquid flows into an existing vane-type multi-back pressure structure, high-pressure liquid remains in the dead volume V4 (shown in FIGS. 6 and 9) between the rotor and a nose portion of the vane 1351, 1352, 1353, and a chattering phenomenon occurs by pushing the vane 1351, 1352, 1353 in a section where the back pressure drops. Accordingly, in the rotary compressor 100 according to embodiments disclosed herein, at least one back pressure pocket 1315*a*, 1315*b*, 1325*a*, 1325*b*, which is concavely disposed to communicate with the compression space V, is provided in at least one of the main bearing 131 or the sub bearing 132, the back pressure chamber 1343*a*, 1343*b*, 1343*c* in which a rear end of the vane 1351, 1352, 1353 is accommodated to receive a back pressure from the back pressure pocket 1315*a*, 1315*b*, 1325*a*, 1325*b* while communicating with the back pressure pocket 1315*a*, 1315*b*, 1325*a*, 1325*b* so as to pressurize the vane 1351, 1352, 1353 toward the inner periphery of the cylinder 133 is disposed at an inner end of the vane slot 1342*a*, 1342*b*, 1342*c*, and the back pressure pocket 1315*a*, 1315*b*, 1325*a*, 1325*b* communicates with the back pressure chamber 1343*a*, 1343*b*, 1343*c* to allow the front end surface 1351*a*, 1352*a*, 1353*a* of the vane 1351, 1352, 1353 to come into contact with the inner periphery of the cylinder 133 until high-pressure refrigerant is bypassed to the suction port 1331. Due to this, high-pressure refrigerant which may be accumulated between the front end of the vane 1351, 1352, 1353 and the inner periphery of the cylinder 133 may be bypassed to the suction port 1331 on a side surface of the cylinder 133, and a discharge back pressure may be maintained not to allow the vane 1351, 1352, 1353 to be pushed back until the high-pressure refrigerant is bypassed to the suction port 1331 on the side surface of the cylinder 133.

In FIG. 7, an example is shown in which a high pressure is defined in the first main back pressure pocket 1315*a* and the first sub back pressure pocket 1325*a* on the left side, and an intermediate pressure is defined in the second main back pressure pocket 1315*b* and the second sub back pressure pocket 1325*b* on the right side. The first back pressure chamber 1343*a* and the third back pressure chamber 1343*c* are in communication with the first main back pressure pocket 1315*a* and the first sub back pressure pocket 1325*a*, and an example in which the first back pressure chamber 1343*a* is disposed to communicate with the first main back pressure pocket 1315*a* and the first sub back pressure pocket 1325*a* until the first vane 1351 comes into contact with a starting point of the suction port 1331 of the cylinder 133 as the contact point is shown. In addition, referring to FIG. 7, a back pressure Pd in the first main back pressure pocket 1315*a*; a pressure Pvd between the front end surface 1351*a* (FIG. 9) of the first vane 1351, an inner periphery of the cylinder 133, and a contact point in contact with an outer periphery of the roller 134 and the inner periphery of the cylinder 133; a back pressure Pvh of the back pressure chamber 1343*a* at an inner end of the vane slot 1342*a* (FIG. 9); and a back pressure Pm in the second main back pressure pocket 1315*b* are shown.

These pressures may satisfy a condition of [Equation 1] until the first vane 1351 passes through the front end surface 1351*a* of the first vane 1351, an inner periphery of the cylinder 133, and a contact point in contact with an outer periphery of the roller 134 and the inner periphery of the cylinder 133, and passes through the suction port 1331.

$$Pd=Pdv=Pvh>Pm \quad \text{[Equation 1]}$$

By satisfying [Equation 1], pressures at the front end surface 1351*a* and at the rear end of the first vane 1351 may be defined to be the same, thereby suppressing a chattering in which the first vane 1351 strikes near the cylinder 133 from occurring.

Further, as described above, in order to satisfy [Equation 1], the first main back pressure pocket 1315*a* and/or the first sub back pressure pocket 1325*a* must maintain a state of communicating with the first back pressure chamber 1343*a*. In FIG. 3, the first back pressure chamber 1343*a* maintains a state of communicating with the first main back pressure pocket 1315*a* and/or the first sub back pressure pocket 1325*a* even when the first vane 1351 is in contact with one side of the suction port 1331 of the cylinder 133.

Due to such a configuration, the rotary compressor 100 according to embodiments disclosed herein may have a structure capable of maintaining a high-pressure back pressure at the rear end of the vane 1351, 1352, 1353, thereby maintaining a discharge back pressure so as not to push the vane 1351, 1352, 1353 back until accumulated high-pressure refrigerant is bypassed to the suction port on a side surface of the cylinder. In addition, the rotary compressor 100 according to embodiments disclosed herein may have a structure in which the back pressure pocket 1315*a*, 1315*b*, 1325*a*, 1325*b* is provided in one of the main bearing 131 and the sub bearing 132, the back pressure chamber 1343*a*, 1343*b*, 1343*c* is disposed at an inner end of the vane slot 1342*a*, 1342*b*, 1342*c*, and the high-pressure back pressure pocket 1315*a*, 1315*b*, 1325*a*, 1325*b* communicates with the back pressure chamber 1343*a*, 1343*b*, 1343*c* so as to allow the front end surface 1351*a*, 1352*a*, 1353*a* of the vane 1351, 1352, 1353 to come into contact with an inner periphery of the cylinder 133, thereby bypassing high-pressure refrigerant that can be accumulated between the front end surface 1351*a*, 1352*a*, 1353*a* of the vane 1351, 1352, 1353 and the inner periphery of the cylinder 133 to the suction port 1331 on a side surface of the cylinder 133, and maintaining a discharge back pressure so as not to push the vane 1351, 1352, 1353 back until the high-pressure refrigerant is bypassed to the suction port 1331 on the side surface of the cylinder.

A discharge back pressure may be maintained so as not to push the vane 1351, 1352, 1353 back until the high-pressure refrigerant accommodated in the dead volume V4 between the vane 1351, 1352, 1353 and the cylinder 133 is bypassed to the suction port 1331 on a side surface of the cylinder 133, thereby preventing chattering in a suction section to improve reliability. Further, the rotary compressor 100 according to embodiments disclosed herein may change a discharge back pressure angle to reduce chattering, in particular, to suppress a suction port stamping phenomenon through the reduced chattering under refrigerant inflow and low load conditions.

Referring to FIG. 8, with the center of the roller 134 defined as the origin, an angle A between a contact point P1 in contact with an outer periphery of the roller 134 and an inner periphery of the cylinder 133, and one side of the suction port 1331 may be 38 to 40 degrees. A high-pressure discharge back pressure must be provided to a rear end of the vane 1351, 1352, 1353 up to 40 degrees. When a high-pressure discharge back pressure is provided to the rear end of the vane 1351, 1352, 1353 to a position where the angle A is 40 degrees or more, there is a problem in that a mechanical friction loss between the vane 1351, 1352, 1353 and the cylinder 133 is increased and a reliability issue is generated.

In FIG. 9, a dead volume V4 is shown where high-pressure refrigerant is accommodated in the front end surface 1351*a*, 1352*a*, 1353*a* of the vane 1351, 1352, 1353, the contact point P1 between the rotor and the cylinder 133, and the inner periphery of the cylinder 133. High-pressure gas and liquid are accumulated in the dead volume V4 of FIG. 9, and a pressure due to high-pressure refrigerant in the dead volume V4 is applied to the front end surface 1351*a*, 1352*a*, 1353*a* of the vane 1351, 1352, 1353 until the vane 1351, 1352, 1353 is bypassed to the suction port 1331 of the cylinder 133. Of course, it has been described that the occurrence of chattering is suppressed by applying a high pressure to a rear end of the vane 1351, 1352, and 1353 so as to apply a uniform pressure to the front and rear ends of the vane 1351, 1352, 1353.

In addition, FIG. 10A shows an acting force by a discharge pressure applied to a rear end of the vane 1351, 1352, 1353 when the front end surface 1351*a*, 1352*a*, 1353*a* of the vane 1351, 1352, 1353 is disposed adjacent to a contact point of the cylinder 133, and an example is shown in which the back pressure chamber 1343*a*, 1343*b*, 1343*c* communicates with the first main back pressure pocket 1315*a* and the first sub back pressure pocket 1325*a* to provide a discharge pressure from the first main back pressure pocket 1315*a* and the first sub back pressure pocket 1325*a* to the back pressure chamber 1343*a*, 1343*b*, 1343*c*, and a discharge back pressure is provided through the rear end surface 1351*b*, 1352*b*, 1353*b* of the vane 1351, 1352, 1353, and the pressurization flow path groove 1351*c*, 1352*c*, 1353*c*. In FIG. 10A, when the first main back pressure pocket 1315*a* and the first sub back pressure pocket 1325*a* communicate with the back pressure chamber 1343*a*, 1343*b*, 1343*c*, the second main back pressure pocket 1315*b* and the second sub back pressure pocket 1315*b* do not communicate with the back pressure chamber 1343*a*, 1343*b*, 1343*c*.

On the other hand, FIG. 10B shows an acting force by an intermediate pressure applied to a rear end of the vane 1351, 1352, 1353 when the front end surface 1351*a*, 1352*a*, 1353*a* of the vane 1351, 1352, 1353 is disposed adjacent to a contact point of the cylinder 133, and an example is shown in which the back pressure chamber 1343*a*, 1343*b*, 1343*c* communicates with the second main back pressure pocket 1315*b* and the second sub back pressure pocket 1325*b* to provide an intermediate pressure from the second main pressure pocket 1315*b* and the second sub back pressure pocket 1325*b* to the back pressure chamber 1343*a*, 1343*b*, 1343*c*, and an intermediate back pressure is provided through the rear end surface 1351*b*, 1352*b*, 1353*b* of the vane 1351, 1352, 1353, and the pressurization flow path groove 1351*c*, 1352*c*, 1353*c*. Further, in FIG. 10B, when the second main back pressure pocket 1315*b* and the second sub back pressure pocket 1325*b* communicate with the back pressure chamber 1343*a*, 1343*b*, 1343*c*, the first main back pressure pocket 1315*a* and the first sub back pressure pocket 1325*a* do not communicate with the back pressure chamber 1343*a*, 1343*b*, 1343*c*.

Figures 11, 12:
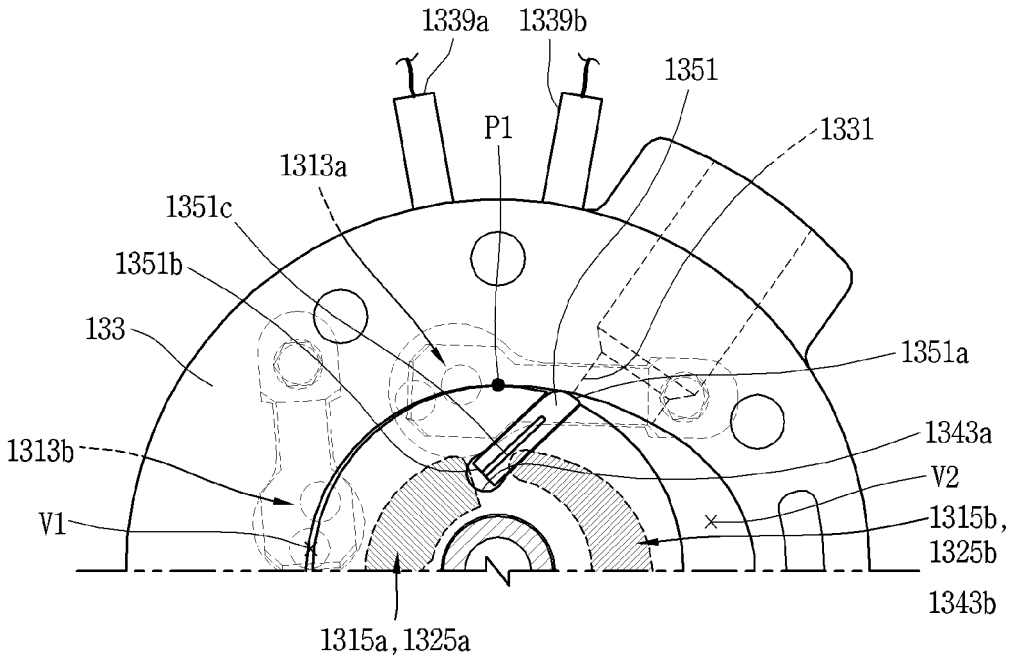
FIG. 11 is a conceptual view showing an example in which acceleration sensors are provided at a discharge port side and a suction port side, respectively.
FIG. 12 is a table showing a result of measuring accelerations at the discharge port side and the suction port side before liquid inflow and during liquid inflow in FIG. 11.
Figure 13:
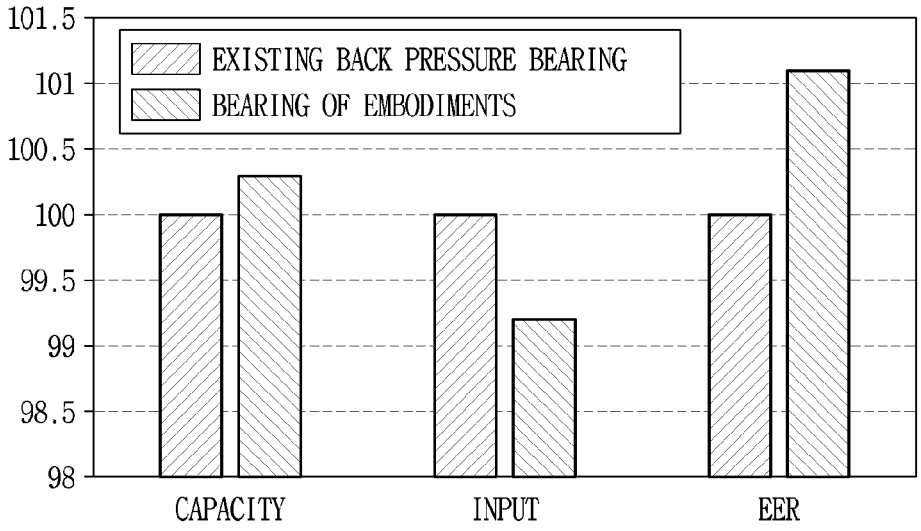
FIG. 13 is a graph showing a comparison between efficiencies of the related art and embodiments.

FIG. 11 is a conceptual view showing an example in which acceleration sensors are provided at a side of a discharge port and a side of a suction port, respectively. FIG. 12 is a table showing a result of measuring accelerations at the side of the discharge port and the side of the suction port before liquid inflow and during liquid inflow in FIG. 11. FIG. 13 is a graph showing a comparison between efficiencies of the related art and embodiments.

Referring to FIGS. 11 and 12, in order to determine the presence or absence of chattering, acceleration sensors are provided in the cylinders 133 of the existing structure and the structure according to embodiments disclosed herein to measure their accelerations. When a stabilization state of the existing structure is compared to 100%, it may be seen that chattering is induced as an increase in acceleration due to over-compression is increased by 286% on the discharge side during liquid inflow, and is increased by 343% on the suction side compared to an acceleration in a stable state of suction.

In FIG. 12, as a result of measuring an acceleration of the structure according to embodiments disclosed herein, it may be seen that there is a portion where the acceleration slightly increases on the suction side before liquid inflow because a contact force between the vane 1351, 1352, 1353 and the cylinder 133 increases compared to the existing structure, but it is not a level of concern, and chattering hardly occurs at a level of 75% on the discharge side and at a level of 110% on the suction side compared to the stable state of the existing structure during liquid inflow.

Further, referring to FIG. 13, as a result of reviewing air conditioning compressor cooling standard conditions to examine an effect of efficiency, in the rotary compressor 100 according to embodiments disclosed herein, it may be seen that the efficiency is improved by 1.1% as the cooling capacity increases and the input decreases by the application of the main/sub bearing according to embodiments disclosed herein compared to the bearings at the existing back pressure angle.

In the rotary compressor according to embodiments disclosed herein, there may be provided a structure capable of maintaining a high-pressure back pressure at a rear end of the vane, thereby maintaining a discharge back pressure so as not to push the vane back until accumulated high-pressure refrigerant is bypassed to the suction port on a side surface of the cylinder. In addition, the rotary compressor according to embodiments disclosed herein may have a structure in which a back pressure pocket is provided in one of a main bearing or a sub bearing, a back pressure chamber is disposed at an inner end of a vane slot, and the high-pressure back pressure pocket communicates with the back pressure chamber so as to allow a front end surface of a vane to come into contact with an inner periphery of a cylinder, thereby bypassing high-pressure refrigerant, which may be accumulated between a front end of the vane and an inner periphery of the cylinder to a suction port on a side surface of the cylinder, and maintaining a discharge back pressure so as not to push the vane back until the high-pressure refrigerant is bypassed to the suction port on the side surface of the cylinder. A discharge back pressure may be maintained so as not to push the vane back until the high-pressure refrigerant accommodated in a dead volume between the vane and the cylinder is bypassed to the suction port on a side surface of the cylinder, thereby preventing chattering in a suction section to improve reliability.

Further, the rotary compressor according to embodiments disclosed herein may change a discharge back pressure angle to suppress chattering, in particular, to suppress a suction port stamping phenomenon through the suppressed chattering under refrigerant inflow and low load conditions.

Also, in the rotary compressor according to embodiments disclosed herein, loss due to dropping in the vane is reduced under the efficiency condition to improve efficiency by 1.1%.

Configurations and methods according to the above-described embodiments will not be applicable in a limited way to a lamp using the foregoing rotary compressor 100, and all or a portion of each embodiment may be selectively combined and configured to make various modifications thereto.

Embodiments disclosed herein are designed to solve the foregoing problems, and embodiments disclosed herein provide a rotary compressor having a structure in which a discharge back pressure is maintained so as not to push a vane back until accumulated high-pressure refrigerant is bypassed to a suction port at a side surface of a cylinder. Embodiments disclosed herein further provide a rotary compressor having a structure capable of preventing chattering in a suction section to improve reliability. In particular, embodiments disclosed herein provide a structure that maintains the discharge back pressure up to the suction port rather than near a contact point to reduce chattering and leakage so as to reduce chattering due to residual gas at a front end of the vane in a rotary compressor for automobiles or air conditioning, thereby improving performance.

Embodiments disclosed herein provide a rotary compressor having a structure in which a discharge back pressure extends to a suction start time point so as to reduce an indicated loss through a vane nose. Embodiments disclosed herein also provide a structure that changes a shape of a back pressure pocket for reducing a surface pressure of a suction section to reduce a surface pressure of a suction section in a vane-type compressor for vehicles or air conditioning to improve reliability and reduce an indicated loss.

Embodiments disclosed herein provide a rotary compressor having a structure capable of bypassing high-pressure refrigerant that can be accumulated between a front end of the vane and an inner periphery of the cylinder to the suction port at a side of the cylinder, and maintaining a discharge back pressure so as not to push the vane back until the high-pressure refrigerant bypasses to the suction port at the side of the cylinder.

Embodiments disclosed herein provide a rotary compressor that may include a cylinder having an inner peripheral surface defined in an annular shape to define a compression space, and provided with a suction port configured to communicate with the compression space to suction and provide refrigerant; a roller rotatably provided in the compression space of the cylinder, and provided with a plurality of vane slots providing a back pressure at one side thereinside at a predetermined interval along an outer peripheral surface; and a plurality of vanes slidably inserted into the vane slots to rotate together with the roller, front end surfaces of which come into contact with an inner periphery of the cylinder by the back pressure to partition the compression space into a plurality of compression chambers. High-pressure refrigerant may be accommodated between one of the plurality of vanes and an inner periphery of the cylinder, and the back pressure may be maintained at a predetermined level to allow the front end surface of the vane to come into contact with the inner periphery of the cylinder until the high-pressure refrigerant is bypassed to the suction port. Due to this, there may be provided a structure capable of maintaining a high-pressure back pressure at a rear end of the vane, thereby maintaining a discharge back pressure so as not to push the vane back until accumulated high-pressure refrigerant is bypassed to the suction port on a side surface of the cylinder.

The rotary compressor may further include a main bearing and a sub bearing provided at both ends of the cylinder, respectively, and disposed to be spaced apart from each other to define both surfaces of the compression space, respectively. At least one back pressure pocket concavely disposed to communicate with the compression space may be provided on at least one of the main bearing or the sub bearing, a back pressure chamber in which a rear end of the vane is accommodated may be disposed at an inner end of the vane slot so as to receive a back pressure from the back pressure pocket while communicating with the back pressure pocket to pressurize the vane toward the inner periphery of the cylinder, and the back pressure pocket communicates with the back pressure chamber to allow a front end surface of the vane to come into contact with the inner periphery of the cylinder until the high-pressure refrigerant is bypassed to the suction port. According to the foregoing structure, high-pressure refrigerant which may be accumulated between a front end of the vane and an inner periphery of the cylinder may be bypassed to the suction port at a side of the cylinder, and a discharge back pressure may be maintained so as not to push the vane back until the high-pressure refrigerant bypasses to the suction port at the side of the cylinder.

The main bearing may include a main plate portion coupled to the cylinder to cover an upper side of the cylinder. The back pressure pocket may include first and second main back pressure pockets disposed to be spaced apart from a lower surface of the main plate portion at a predetermined distance.

The sub bearing may include a sub plate portion coupled to the cylinder to cover a lower side of the cylinder. The back pressure pocket may further include first and second sub back pressure pockets disposed to be spaced apart from a lower surface of the sub plate portion at a predetermined distance. A back pressure in the first main back pressure pocket may be greater than that in the second main back pressure pocket.

At least a portion of the back pressure chamber may be defined as an arc surface, and a diameter of the arc surface of the back pressure chamber may be smaller than a distance between the first main back pressure pocket and the second main back pressure pocket.

A back pressure Pd in the first main back pressure pocket, a pressure Pdv between a front end surface of the vane, an inner periphery of the cylinder, and a contact point in contact with an outer periphery of the roller and the inner periphery of the cylinder, a back pressure Pvh in the back pressure chamber at an inner end of the vane slot, and a back pressure Pm in the second main back pressure pocket may satisfy a condition of [Equation 1] until the vane passes through the front end surface of the vane, the inner periphery of the cylinder, and the contact point in contact with the outer periphery of the roller and the inner periphery of the cylinder, and passes through the suction port.

$$Pd=Pdv=Pvh>Pm \quad \text{[Equation 1]}$$

The first and second main back pressure pockets, and the first and second sub back pressure pockets may have an inner peripheral surface defined in a circular arc, and an outer peripheral surface defined in an elliptical arc. When the center of the roller is defined as the origin, an angle between a contact point in contact with an outer periphery of the roller and an inner periphery of the cylinder, and one side of the suction port may be 38 to 40 degrees.

Further, a front end surface of the vane in contact with an inner peripheral surface of the cylinder may be defined in a curved surface. The high-pressure refrigerant may be accommodated between the front end surface, an inner periphery of the cylinder, and a contact point in contact with an outer periphery of the roller and the inner periphery of the cylinder.

Embodiments disclosed herein further provide a rotary compressor that may include a casing; a drive motor provided inside of the casing to generate rotational power; a cylinder having an inner peripheral surface defined in an annular shape to define a compression space, and provided with a suction port configured to communicate with the compression space to suction and provide refrigerant; a roller provided in the compression space of the cylinder so as to be rotatable by rotational power transmitted from the drive motor, and provided with a plurality of vane slots providing a back pressure at one side thereinside at a predetermined interval along an outer peripheral surface; a plurality of vanes slidably inserted into the vane slots to rotate together with the roller, front end surfaces of which come into contact with an inner periphery of the cylinder by the back pressure to partition the compression space into a plurality of compression chambers; and a main bearing and a sub bearing provided at both ends of the cylinder, respectively, and disposed to be spaced apart from each other to define both surfaces of the compression space, respectively. High-pressure refrigerant may be accommodated between one of the plurality of vanes and an inner periphery of the cylinder, and the back pressure may be maintained at a predetermined level to allow the front end surface of the vane to come into contact with the inner periphery of the cylinder until the high-pressure refrigerant is bypassed to the suction port. Due to this, there may be provided a structure capable of maintaining a high-pressure back pressure at a rear end of the vane, thereby maintaining a discharge back pressure so as not to push the vane back until accumulated high-pressure refrigerant is bypassed to the suction port on a side surface of the cylinder.

The drive motor may include a stator fixedly provided on an inner periphery of the casing; a rotor rotatably inserted into the stator; and a rotational shaft coupled to an inside of the rotor to rotate together with the rotor, and connected to the roller to transmit a rotational force allowing the roller to rotate. At least one back pressure pocket concavely disposed to communicate with the compression space may be provided on at least one of the main bearing or the sub bearing. A back pressure chamber is disposed at an inner end of the vane slot so as to receive a back pressure from the back pressure pocket while communicating with the back pressure pocket to pressurize the vane toward the inner periphery of the cylinder, and the back pressure pocket communicates with the back pressure chamber to allow a front end surface of the vane to come into contact with the inner periphery of the cylinder until the high-pressure refrigerant is bypassed to the suction port. According to the foregoing structure, high-pressure refrigerant which may be accumulated between a front end of the vane and an inner periphery of the cylinder may be bypassed to the suction port at a side of the cylinder, and a discharge back pressure may be maintained so as not to push the vane back until the high-pressure refrigerant bypasses to the suction port at the side of the cylinder.

The main bearing may include a main plate portion coupled to the cylinder to cover an upper side of the cylinder. The back pressure pocket may include first and second main back pressure pockets disposed to be spaced apart from a lower surface of the main plate portion at a predetermined distance.

The sub bearing may include a sub plate portion coupled to the cylinder to cover a lower side of the cylinder. The back pressure pocket may further include first and second sub back pressure pockets disposed to be spaced apart from a lower surface of the sub plate part at a predetermined distance. A back pressure in the first main back pressure pocket may be greater than that in the second main back pressure pocket.

A back pressure Pd in the first main back pressure pocket, a pressure Pdv between a front end surface of the vane, an inner periphery of the cylinder, and a contact point in contact an outer periphery of the roller and the inner periphery of the cylinder, a back pressure Pvh in the back pressure chamber at an inner end of the vane slot, and a back pressure Pm in the second main back pressure pocket may satisfy a condition of [Equation 1] until the vane passes through the front end surface of the vane, the inner periphery of the cylinder, and the contact point in contact with the outer periphery of the roller and the inner periphery of the cylinder, and passes through the suction port.

$$Pd=Pdv=Pvh>Pm \quad \text{[Equation 1]}$$

The first and second main back pressure pockets, and the first and second sub back pressure pockets may have an inner peripheral surface defined in a circular arc, and an outer peripheral surface defined in an elliptical arc. When the center of the roller is defined as the origin, an angle between a contact point in contact with an outer periphery of the roller and an inner periphery of the cylinder, and one side of the suction port may be 38 to 40 degrees.

A front end surface of the vane in contact with an inner peripheral surface of the cylinder may be defined in a curved surface. The high-pressure refrigerant may be accommodated between the front end surface, an inner periphery of the cylinder, and a contact point in contact with an outer periphery of the roller and the inner periphery of the cylinder.

It is obvious to those skilled in the art that embodiments may be embodied in other specific forms without departing from the concept and essential characteristics thereof. The above description is therefore to be construed in all aspects as illustrative and not restrictive. The scope should be determined by reasonable interpretation of the appended claims and all changes that come within the equivalent scope are included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a cylinder having an inner peripheral surface that defines a compression space, and provided with a suction port configured to communicate with the compression space and through which refrigerant is suctioned into the compression space;

a roller rotatably provided in the compression space of the cylinder, and having a plurality of vane slots that provides a back pressure at one side thereinside and that is provided at a predetermined interval along an outer peripheral surface of the roller; and a plurality of vanes slidably inserted into the plurality of vane slots, respectively, and configured to rotate together with the roller, front end surfaces of which come into contact with the inner peripheral surface of the cylinder due to the back pressure to partition the compression space into a plurality of compression chambers, wherein high-pressure refrigerant is accommodated between one vane of the plurality of vanes and the inner peripheral surface of the cylinder, and wherein the back pressure is maintained at a predetermined level to allow the front end surface of the one vane of the plurality of vanes to come into contact with the inner peripheral surface of the cylinder until the high-pressure refrigerant is bypassed to the suction port.

2. The rotary compressor of claim 1, further comprising:

a main bearing and a sub bearing provided at ends of the cylinder, respectively, and spaced apart from each other to define surfaces of the compression space, respectively, wherein at least one back pressure pocket is concavely disposed to communicate with the compression space on at least one of the main bearing or the sub bearing, wherein a back pressure chamber in which a rear end of the one vane of the plurality of vanes is accommodated is disposed at an inner end of the respective vane slot so as to receive a back pressure from the back pressure pocket while communicating with the back pressure pocket to pressurize the one vane of the plurality of vanes toward the inner peripheral surface of the cylinder, and wherein the back pressure pocket communicates with the back pressure chamber to allow a front end surface of the one vane of the plurality of vanes to come into contact with the inner peripheral surface of the cylinder until the high-pressure refrigerant is bypassed to the suction port.

3. The rotary compressor of claim 2, wherein the main bearing comprises a main plate portion coupled to the cylinder to cover an upper side of the cylinder, and wherein the back pressure pocket comprises first and second main back pressure pockets spaced apart on a lower surface of the main plate portion at a predetermined distance.

4. The rotary compressor of claim 3, wherein the sub bearing comprises a sub plate portion coupled to the cylinder to cover a lower side of the cylinder, and wherein the back pressure pocket further comprises first and second sub back pressure pockets spaced apart on a lower surface of the sub plate portion at a predetermined distance.

5. The rotary compressor of claim 3, wherein a back pressure in the first main back pressure pocket is greater than a back pressure in the second main back pressure pocket.

6. The rotary compressor of claim 3, wherein at least a portion of the back pressure chamber is defined as an arc surface, and wherein a diameter of the arc surface of the back pressure chamber is smaller than a distance between the first main back pressure pocket and the second main back pressure pocket.

7. The rotary compressor of claim 3, wherein a back pressure Pd in the first main back pressure pocket; a pressure Pdv between a front end surface of the one vane of the plurality of vanes, the inner peripheral surface of the cylinder, and a contact point in contact with the outer peripheral surface of the roller and the inner peripheral surface of the cylinder; a back pressure Pvh in the back pressure chamber at an inner end of the respective vane slot; and a back pressure Pm in the second main back pressure pocket satisfy:

a condition of the following [Equation 1] until the one vane of the plurality of vanes passes through the contact point in contact with the outer peripheral surface of the roller and the inner peripheral surface of the cylinder and through the suction port.

$$Pd=Pdv=Pvh>Pm \quad \text{[Equation 1]}$$

8. The rotary compressor of claim 4, wherein the first and second main back pressure pockets and the first and second sub back pressure pockets each have an inner peripheral surface defined in a circular arc and an outer peripheral surface defined in an elliptical arc.

9. The rotary compressor of claim 1, wherein when a center of the roller is defined as the origin, an angle is defined out from the origin between a contact point in contact with the outer peripheral surface of the roller and the inner peripheral surface of the cylinder and one side of the suction port, the angle has a measurement of 38 to 40 degrees.

10. The rotary compressor of claim 1, wherein a front end surface of each vane in contact with the inner peripheral surface of the cylinder is defined in a curved surface, and wherein the high-pressure refrigerant is accommodated between the front end surface, the inner peripheral surface of the cylinder, and a contact point in contact with the outer peripheral surface of the roller and the inner peripheral surface of the cylinder.

11. A rotary compressor, comprising:

a casing;

a drive motor provided inside of the casing to generate rotational power;

a cylinder having an inner peripheral surface that defines a compression space, and provided with a suction port configured to communicate with the compression space and through which refrigerant is suctioned into the compression space;

a roller provided in the compression space of the cylinder so as to be rotatable by the rotational power transmitted from the drive motor, and having a plurality of vane slots that provides a back pressure at one side therein-side and that is provided at a predetermined interval along an outer peripheral surface of the roller;

a plurality of vanes slidably inserted into the plurality of vane slots, respectively, to rotate together with the roller, front end surfaces of which come into contact with the inner peripheral surface of the cylinder due to the back pressure to partition the compression space into a plurality of compression chambers; and a main bearing and a sub bearing provided at ends of the cylinder, respectively, and spaced apart from each other to define surfaces of the compression space, respectively, wherein high-pressure refrigerant is accommodated between one vane of the plurality of vanes and the inner peripheral surface of the cylinder, and wherein the back pressure is maintained at a predetermined level to allow the front end surface of the one vane of the plurality of vanes to come into contact with the inner peripheral surface of the cylinder until the high-pressure refrigerant is bypassed to the suction port.

12. The rotary compressor of claim 11, wherein the drive motor comprises:

a stator fixedly provided on an inner peripheral surface of the casing;

a rotor rotatably inserted into the stator; and a rotational shaft coupled to an inside of the rotor to rotate together with the rotor, and connected to the roller to transmit a rotational force allowing the roller to rotate.

13. The rotary compressor of claim 11, wherein at least one back pressure pocket is concavely disposed to communicate with the compression space on at least one of the main bearing or the sub bearing, wherein a back pressure chamber is disposed at an inner end of the respective vane slot so as to receive a back pressure from the back pressure pocket while communicating with the back pressure pocket to pressurize the one vane of the plurality of vanes toward the inner peripheral surface of the cylinder, and wherein the back pressure pocket communicates with the back pressure chamber to allow a front end surface of the one vane of the plurality of vanes to come into contact with the inner peripheral surface of the cylinder until the high-pressure refrigerant is bypassed to the suction port.

14. The rotary compressor of claim 13, wherein the main bearing comprises a main plate portion coupled to the cylinder to cover an upper side of the cylinder, and wherein the back pressure pocket comprises first and second main back pressure pockets spaced apart from a lower surface of the main plate portion at a predetermined distance.

15. The rotary compressor of claim 14, wherein the sub bearing comprises a sub plate portion coupled to the cylinder to cover a lower side of the cylinder, and wherein the back pressure pocket further comprises first and second sub back pressure pockets spaced apart from a lower surface of the sub plate portion at a predetermined distance.

16. The rotary compressor of claim 14, wherein a back pressure in the first main back pressure pocket is greater than a back pressure in the second main back pressure pocket.

17. The rotary compressor of claim 15, wherein a back pressure Pd in the first main back pressure pocket; a pressure Pdv between a front end surface of the one vane of the plurality of vanes, the inner peripheral surface of the cylinder, and a contact point in contact the outer peripheral surface of the roller and the inner peripheral surface of the cylinder; a back pressure Pvh in the back pressure chamber at an inner end of the respective vane slot; and a back pressure Pm in the second main back pressure pocket satisfy:

a condition of the following [Equation 1] until the one vane of the plurality of vanes passes through the contact point in contact with the outer peripheral surface of the roller and the inner periphery of the cylinder and through the suction port.

$$Pd=Pdv=Pvh>Pm \text{[Equation 1]}$$

18. The rotary compressor of claim 15, wherein the first and second main back pressure pockets and the first and second sub back pressure pockets each have an inner peripheral surface defined in a circular arc and an outer peripheral surface defined in an elliptical arc.

19. The rotary compressor of claim 11, wherein when a center of the roller is defined as the origin, an angle is defined out from the origin between a contact point in contact with the outer peripheral surface of the roller and the inner peripheral surface of the cylinder and one side of the suction port, the angle has a measurement of 38 to 40 degrees.

20. The rotary compressor of claim 11, wherein a front end surface of the one vane of the plurality of vanes in contact with the inner peripheral surface of the cylinder is defined in a curved surface, and wherein the high-pressure refrigerant is accommodated between the front end surface, the inner peripheral surface of the cylinder, and a contact point in contact with the outer peripheral surface of the roller and the inner peripheral surface of the cylinder.

* * * * *